US008336142B1

(12) United States Patent
See et al.

(10) Patent No.: US 8,336,142 B1
(45) Date of Patent: Dec. 25, 2012

(54) BODY AND HEAD SUPPORT

(76) Inventors: Jeffrey J. See, Indian Rocks Beach, FL (US); Damon A. Johnston, Spring Hill, FL (US)

( * ) Notice: Subject to any disclaimer, the term of this patent is extended or adjusted under 35 U.S.C. 154(b) by 781 days.

(21) Appl. No.: 12/378,615

(22) Filed: Feb. 17, 2009

Related U.S. Application Data

(60) Provisional application No. 61/065,950, filed on Feb. 15, 2008.

(51) Int. Cl.
*A47C 20/12* (2006.01)

(52) U.S. Cl. ..... 5/634; 5/633; 5/640

(58) Field of Classification Search ..... 5/633–634, 5/621–624, 640, 643
See application file for complete search history.

(56) References Cited

U.S. PATENT DOCUMENTS 274,392 A * 3/1883 Sargent ..... 5/618
804,750 A 11/1905 Meinecke
1,281,074 A * 10/1918 Russell ..... 5/634
2,612,645 A 10/1952 Boland
3,648,308 A 3/1972 Greenawalt
4,528,705 A 7/1985 Greenawalt
4,780,921 A 11/1988 Lahn et al.
4,805,603 A 2/1989 Cumberland
4,829,614 A 5/1989 Harper
4,918,774 A 4/1990 Popitz
4,928,336 A 5/1990 Petillo, Sr.
4,932,089 A 6/1990 Laviero
5,184,365 A 2/1993 Stafford
5,528,783 A 6/1996 Kunz et al.
D407,259 S 3/1999 Jackson
D416,428 S 11/1999 Jackson
6,047,425 A 4/2000 Khazaal
6,327,725 B1 12/2001 Veilleux et al.
6,357,066 B1 3/2002 Pierce
6,397,415 B1 6/2002 Hsieh
6,446,288 B1 9/2002 Pi
6,510,574 B2 1/2003 Sharrock et al.
6,718,510 B2 * 4/2004 Kojima ..... 714/784
6,751,818 B2 6/2004 Troop

* cited by examiner

*Primary Examiner* — Fredrick Conley
(74) *Attorney, Agent, or Firm* — Frijouf, Rust & Pyle, P.A.

(57) ABSTRACT

A support device is disclosed for positioning an individual in an inclined orientation.

34 Claims, 26 Drawing Sheets

BODY AND HEAD SUPPORT

CROSS-REFERENCE TO RELATED APPLICATIONS

This application claims benefit of U.S. Patent Provisional application Ser. No. 61/065,950 filed Feb. 15, 2008. All subject matter set forth in provisional application Ser. No. 61/065,950 is hereby incorporated by reference into the present application as if fully set forth herein.

BACKGROUND OF THE INVENTION

1. Field of the Invention

This invention relates to support devices and more particularly to a support device for elevating the body and head of an individual to an inclined position for aligning the upper airway of the individual.

2. Background of the Invention

Positioning of an individual's body, head, arms and legs in a static position and for lengthy durations may be beneficial in order to promote comfort. The individual's body, head, arms and legs may require positioning at different elevations to configure the individual into a specific alignment for facilitating an internal and/or an external physical condition. More importantly the positioning of an individual's body, head, arms and legs may be required to insert a medical device into the individual or to administer a chemical or a psychological treatment to an individual.

Various types of support devices have been proposed by the prior art for supporting a portion of an individual. The following U.S. patents are examples of attempt of the prior art to solve these problems.

U.S. Pat. No. 305,761 to Sargent discloses an adjustable head rest for bedsteads and its supporting or carrying frame of a screw rod, screw nut, a shaft, links connecting the shaft and the headrest, gear wheels, and stationary rack bars.

U.S. Pat. No. 397,394 to Smedes discloses a divided embalming board and folding legs, pivoted to the main frame and adapted to be folded up within the frame, in combination with the folding divided side rails, hinged to the frame and provided with recesses and spring latches.

U.S. Pat. No. 812,240 to Schoettl discloses an operating table comprising the legs, side bars, table top hinged at one end and rack and pinion mechanism operable by a crank for raising and lowering the top from its other end. The top is normally set in between the side bars. The side bars and the top are independently composed of hinged sections in end to end relation with the pintles of the hinges in line with each other and about on a line with the transverse center of the table so that they may be together folded downwardly and also so that the top may be independently given the position of a double incline for certain operations and combined with foldable means adjacent to the center of the table for alter the tabletop has been raised to an incline position firmly supporting the hinged end section of the top in its inclined position while the other section of the top is being lowered at its outer end by the rack and pinion mechanism to create the double inclined. The foldable head and foot frames at the ends of the table and one, of which is carried by the free end of the top and means for adjusting the inclination of the frames.

U.S. Pat. No. 852,454 to Ryan discloses a head rest comprising a U-shaped frame. Pivoted members support the extremities of the frame. A toothed segment is integral with one of the pivoted members. A worm engages the segment. A lever is formed integral with the other of the pivoted members. A spring actuated a tension drum. Means connecting the extremity of the lever and the drum, and a sliding stop is adapted to lock the drum in position.

U.S. Pat. No. 933,811 to Worth discloses a head rest comprising a plate provided with a laterally disposed fixed pivot upon one face. An attaching means is upon the opposite face thereof. A swinging arm is mounted upon the pivot and provides a rest at its upper end. A spring has a coiled portion surrounding the pivot and is connected at one end to the arm intermediate its pivot and the rest and has its opposite end connected to a device supported by a member on the plate.

U.S. Pat. No. 942,354 to Ryan discloses a head rest comprising a U-shaped frame. The side members of the frame are pivoted near the free ends thereof and the portions between the pivotal points. The free ends are bent to form short arm levers. Plates have depending flanges secured to the side rails of the bed. The flanges have curved slots in the lower sides thereof. The sides of the frame are pivoted to the depending flanges of the plates. A rod extends through the free ends of the side members and operating in the slots in the flanges. A tube surrounds the rod between the flanges. Means frictionally hold the frame in position. A spring attaches to the short arm levers and adapted to hold the head rest normally in raised position.

U.S. Pat. No. 1,005,916 to Wunning discloses a head rest for beds. A main head rest frame has side members provided with transverse cylindrical heads. Rack plates are adapted to be secured to the side rails of the bedstead and are provided with bearings for the heads. The heads are also provided at their outer ends with downwardly directed arm plates. The rack plates are provided with segmental racks. Locking dogs are mounted between the plates and the arm plates. The upper ends are provided with heads which pass outwardly through the arm plates. Springs are mounted between the lower end portions of the locking dogs and the arm plates. Rotary locking members are pivoted between the locking dogs and the arm plates.

U.S. Pat. No. 1,060,655 to Wood discloses a combination of a base, a support hinged to the base, an extensible member disposed between the base and support, a spring tending to extend the member. Means are operable by movement of the member adapted in a plurality of positions of the member to restrain its contraction and means for releasing the restraining means.

U.S. Pat. No. 1,274,020 to Ebbecke discloses an apparatus of the character specified including a main supporting frame angularly adjustable with relation to the plane of the support. A supporting element provides a body-rest mounted upon the supporting frame. An adjusting means extends from one end-portion of the supporting frame and is adapted to be slid beneath the corresponding end of the body-rest. An adjusting mechanism is connected with the adjusting means. The adjusting mechanism is movable in directions toward or away from the adjusting means. A head-rest is mounted upon the adjusting mechanism and is arranged so that the head-rest can be moved beneath the end-portion of the body-rest or may be moved in an upward direction above the end-portion of the body-rest and toward the body-rest so that a portion of the head-rest will extend over a portion of the body rest.

U.S. Pat. No. 1,331,041 to Anderson discloses a device of the character describing a collapsible support comprising a pair of upper rails, a pair of lower or base rails, and cross-braces between the diagonally opposite upper and lower rails having a hinged connection therewith permitting of a collapsing of the rails toward each other in both vertical and lateral directions and a laterally collapsible table mounted on the upper rails of the support for longitudinal tilting movement and being collapsible therewith.

U.S. Pat. No. 1,336,294 to Hackman discloses a device of the character described comprising a rectangular angle iron base, a support pivotally connected at one end to the base. The support comprises an angle iron frame. Wood fillers are secured in the angle iron side members of the support. A sheet of flexible material are secured across the side members of the support. Perforated lugs are at the free ends of the side members of the support. A screw threaded rod is in the lugs. Guide rods are on the base. Sleeves are one the screw threaded rod and on the guide rods. A toggle lever connects the sleeves.

U.S. Pat. No. 1,866,397 to Clewley discloses a device of the character stated comprises a flat base is adapted to be set on a bed. A pan is designed to fit the trunk of a patient. Mechanical connections are between the pan adjacent its ends and the base and include means by which either or both ends of the pan may be raised and lowered at will. The pan is held at any angle to the base at which it is placed.

U.S. Pat. No. 2,211,453 to Buttikofer discloses a unitary portable back supporting device separate from a bed frame adapted to be readily applied to beds. In combination a base member is adapted to be mounted on a bed frame. A back rest member is hinged at one end to the base member. An electric motor is mounted on one of said members. Means operatively connect the motor to the back rest to raise and lower it about the hinged end thereof. A pair of electric switches are mounted on the back rest and are operatively connected to the motor circuit. Switches are adapted automatically to stop the motor independently of objects external to the device when the back rest member has reached predetermined upper and lower positions.

U.S. Pat. No. 2,787,009 to Hagerty discloses an adjustable head rest attachment for creepers comprising an open U-shaped structure including a pair of spaced arms and a cross member providing a head rest connected to an end of each of the arms. A pair of brackets pivotally secure the opposite ends of the arms for rotation about a common access and are adopted for connection to the opposite side edges of the bed of a creeper with the arms movable in paths outwardly from the edges and with the cross member of movable in an arc from a down position at the bed to an elevated position over the bed, while leaving open and unobstructed the space between the cross member and the bed. Spring means urge the arms and head rest to an elevated position. Plate like portions provide at the last named ends of the arms are arranged in planes perpendicular to the axis for arcuate movement about the axis and are relative to the brackets. The plate-like portions are formed with openings therein are arranged in equally spaced relation to the axis. Pawls are mounted on the brackets for reciprocation parallel to the axis and into an out of engagement in the openings for holding the arms and head rest in selected elevated positions. Spring means urge the pause in to engage positions with the openings. The end of each of the pawls entering the openings are provided with a tapered face proportioned to engage a wall of the openings. A contiguous shoulder is formed to abut the opening to limit the engagement of the pawls in the openings to effect retraction of the pawls from the openings against the resistance of the last name spring means upon manual raising off the head rest. The plate-like portions are formed with openings for receiving the pawls in the down position of the head rest, and the last name openings being proportioned to pass therethrough the contiguous shoulder of the pawls to thereby provide an automatic locking of the head rest in the down position. Manually controlled means withdraw the pawls from the plate like portions to permit raising of the arms and head rest by the first named spring means.

U.S. Pat. No. 3,931,653 to Bien discloses a body rest apparatus having a base to be placed on a support surface and having a back rest actuable to different inclined positions relative to the base by a motor driven screw and nut mechanism located within the dihedral angle formed between the base and back rest elements.

U.S. Pat. No. 4,185,342 to Young discloses a portable, adjustable backrest for use primarily on a bed, sofa or the like which takes the form of a backrest panel which is hingedly connected to a base which is to be placed upon the bed, sofa or the like. The backrest panel is to be adjustable with respect to the base in various inclined positions. The adjustments of the backrest panel is provided through a crank arm assembly which operates through a disc assembly which in turn rolls upon a thin flexible strap assembly. An arm assembly is attached to the disc assembly which is to pivot with the disc assembly. The outer end of the arm assembly is to be in contact with the backside of the backrest panel. The pivoting of the arm assembly to different positions results in locating of the backrest panel to various inclined positions with respect to the base.

U.S. Pat. No. 4,194,732 to Liebman discloses a cardiac patient support comprises a flat base board of a size suitable for supporting a human patient and having an overlying torso supporting board pivotally associated with a bottom end area of the base board and extending angularly upwardly in relation to the latter, a transversely extending roller being mounted upon the base board in engagement with the under side of the torso supporting board and having operating means associated with said eccentric roller for adjustably turning the latter to urge the upper end of the torso supporting board upwardly and to lock said eccentric roller in an adjusted turned position. A handle is disclosed for turning the eccentric roller and a ratchet and pawl assembly is disclosed for locking the eccentric roller in an adjusted, turned position.

U.S. Pat. No. 4,307,477 to Jacobsen discloses a bedding arrangement having a base for disposing on the surface of a bed and an adjustable back support with a frame pivotably mounted at the surface of the base enabling adjustment of the back support into various angular positions relative to the surface of the base. A board for supporting the back of a bed-ridden patient is pivotably mounted on the frame adjacent a head-resting portion of the latter. The board is upwardly pivotable in a direction opposite an upward pivotable movement of the frame whereby the patient assumes a recumbent position raised above the surface of the bed permitting unhindered introduction of a bed pot under the patient.

U.S. Pat. No. 4,458,370 to Fickler discloses a device for adjusting the angular position of a movable support has two frames which are pivotally connected to each other along a pivot axis and are capable of being moved apart by the action of pretensioned torsion spring rods provided near the pivot axis so that the two frames assume variable angular positions with respect to each other. The movable support frame in its upwardly directed angular position may serve as a supporting surface for a mattress at the head end of a bed frame. To effect angular adjustment, two steel cables fastened to one frame are trained over pulleys disposed on the other frame and are guided to a pivot lever pivotably attached to the other frame and are actuated by an electric motor. As the motor is operative, the steel cables cause the frames to be pulled in one direction toward each other against the action of the torsion spring rods and the pneumatic springs. Reversing the direction of the motor will cause the frames to move away from each other due to the action of the torsion spring rods and pneumatic springs.

U.S. Pat. No. 4,620,697 to Pithon discloses a surgical head support unit for an operating table or the like has a common support for a circular headrest which is vertically adjustable and can be tilted and a, handrest for the surgeon disposed outwardly and at least partly around the headrest. The handrest for the surgeon can be adjusted independently of the headrest as to level and tilt. The support is carried by a motor-driven pair of arms which form a parallelogrammatic linkage with the support.

U.S. Pat. No. 4,685,160 to Rizzardo discloses a portable three piece bed assembly is disclosed comprising a foldable spring deck adapted to be easily mounted on a frame assembly which further separates into two pieces to permit easy assembly, disassembly, and transportation of the bed assembly unit by a single individual wherein the unit comprises a body supporting assembly including a multiple-position, back-supporting member and multiple-position, leg and knee supporting members.

U.S. Pat. No. 4,853,990 to Elder, et al. discloses a person-raising device, designed for lifting a person in bed, rests atop a bed and is activated by a linear actuator comprising a dual-threaded lead screw and a small electric motor and gear reduction unit. The small electric motor and gear reduction unit drives the dual-threaded lead screw to raise a pair of support arms, which raises a person resting on the device. The lead screw is enclosed in a slotted tube; this decreases the chance of the lead screw coming into contact with a person using the device.

U.S. Pat. No. 5,165,137 to Amrein, et al. discloses an improved head support stand used to smoothly and accuely position a patient's head when imaging the patient's upper spinal area. The improved stand includes a compound turnbuckle mounted between a base of the stand and a head cradle or face plate mounted to the base. The compound turnbuckle includes two rods threadingly engaged to a turnbuckle body so that the rods translate with respect to the body when it rotates. When the compound turnbuckle is in a fully retracted position, the rods are in a telescoped configuration within the turnbuckle body. When the compound turnbuckle is in a fully extended position, the rods are axially remote from each other and project substantially all the way out of the turnbuckle body.

U.S. Pat. No. 5,257,428 to Carroll, et al. discloses a hospital bed, particularly suitable for home use comprises a plurality of sections which can be releasably connected together, and can be assembled for delivery and storage with head and foot sections, and head and foot boards stacked on a seat section. When thus assembled the bed can be put into a box and for ease of movement wheels project through the bottom of the box. The various sections and parts are releasably connected by pairs of brackets which clip together, the brackets held together by a clip which prevents disengagement. Power means are provided for raising the head section board and the foot section board. The bed has fixed legs which are provided with wheels. Movable legs can also be provided, extendable and retractable. When the movable legs are extended the fixed legs are raised, the wheels clear the floor. Power means are provided for moving the movable legs, and the movable legs, power means and associated parts can be removably mounted on the bed.

U.S. Pat. No. 5,269,031 to Alexander discloses a drive unit for an adjustable bed, comprising motor means and a clutch assembly comprising a toothed gear jack drive coupling, a toothed gear drive coupling and means for engaging and disengaging the jack drive coupling and the drive coupling, wherein the drive coupling is driven by the motor means and wherein the jack drive coupling, when engaged with the drive coupling by the clutch assembly, drives a controller shaft of the adjustable bed to raise or lower a section of the bed.

U.S. Pat. No. 5,425,150 to Palmer, Jr., et al. discloses a device for converting a flat bed into an adjustable bed. The system has a base which mounts on the bed's box-springs and an articulating platform sandwiched between the box-springs and the mattress head section. The articulating platform pivots about the pivoting end of base by inflating bellows. The controls provide for adjustable firmness, degree and speed of pivoting, and delay for the start of the deflating of bellows for lowering articulating platform.

U.S. Pat. No. 5,926,876 to Haigh, et al. discloses a device for adapting a surgical operating table such that the upper torso of the patient can be raised in order to place the patient in a seated position, the device further providing the means of exposing or supporting a side of said patient's upper torso and limbs. The device contains a continuously adjustable positioning mechanism, and corresponding actuator for said mechanism, in a way that a user can rapidly and conveniently put a patient in the desired position, from a supine posture to a fully seated position. Additionally, the device does not render the surgical table permanently modified, as the process of modification is reversible by means of a simple attachment mechanism. The device uses a back support section hingedly connected to a base frame, this base frame providing the attachment support to the surgical table. Side support panels are either moved out of the way on the patient's operative side, or left in place to provide support to the unaffected side. Two embodiments are described that differ solely in the way the back support surface is implemented.

U.S. Pat. No. 6,568,008 to Siepmann, et al. discloses a medical examination table is adapted to receive at least one two-way drawer assembly with a removable locking mechanism and an articulating backrest. The backrest is controlled by a linear actuator and can be adjusted to any desired position. The backrest requires a relatively small amount of space in the table, and therefore, storage capacity of the table is maximized.

Although the aforementioned prior art have contributed to the development of the art of support devices, none of these prior art patents have solved the needs of this art.

Therefore, it is an object of the present invention to provide an improved support device for positioning an individual in an inclined orientation.

Another object of this invention is to provide an improved support device that may be positioned directly on bedding.

Another object of this invention is to provide an improved support device that may both alter the inclination the back of the individual and alter the elevation of the head of the individual.

Another object of this invention is to provide an improved support device that may support the arms of the individual at various angles to the body.

Another object of this invention is to provide an improved support device that is portable and independent of external power sources.

Another object of this invention is to provide an improved support device that aligns the axes of the upper airway for facilitating endotracheal intubation.

Another object of this invention is to decrease the work of the breathing of an obese individual.

Another object of this invention is to decrease transpulmonary shunting, hypoventilation and risk of hypoxia.

Another object of this invention is to decrease the degree of airway obstruction in those with obstructive sleep apnea.

Another object of this invention is to improve manual mask ventilation and the success of laryngeal mask airways.

Another object of this invention is to increase the safe apnea period after induction of anesthesia.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to a support device for positioning an individual in an inclined orientation. The individual has a head secured to a body by a neck. A first arm and a second arm extend from the body. The head has an upper airway and the body has a lower airway for delivering oxygen into the individual. The support device comprises a lower rectangular frame defining a first lower side, a second lower side, a front lower side and a rear lower side. A first lower pivot is secured to the first lower side of the lower rectangular frame at a first position. A second lower pivot is secured to the first lower side of the lower rectangular frame at a second position. The first position and the second position define a first length between the first position and the second position. A third lower pivot is secured to the second lower side of the lower rectangular frame at a third position. A fourth lower pivot is secured to the second lower side of the lower rectangular frame at a fourth position. The third position and the fourth position define a second length between the third position and the fourth position. The first length and the second length having an equivalent dimension. The first position and the third position have a parallel alignment with the second position and the fourth position.

An upper rectangular frame defines a first upper side, a second upper side, a front upper side and a rear upper side. A first upper pivot is secured to the first upper side of the upper rectangular frame at a fifth position. A second upper pivot is secured to the first upper side of the upper rectangular frame at a sixth position. The fifth position and the sixth position define a third length between the fifth position and the sixth position. A third upper pivot is secured to the second upper side of the upper rectangular frame at a seventh position. A fourth upper pivot is secured to the second upper side of the upper rectangular frame at an eighth position. The seventh position and the eighth position defines a fourth length between the seventh position and the eighth position. The third length and the fourth length have an equivalent dimension. The fifth position and the seventh position have a parallel alignment with the sixth position and the eighth position.

A first frame linkage extends between the first lower pivot of the lower rectangular frame to the first upper pivot of the upper rectangular frame for pivoting the upper rectangular frame relative to the lower rectangular frame. A second frame linkage extends between the second lower pivot of the lower rectangular frame to the second upper pivot of the upper rectangular frame for pivoting the upper rectangular frame relative to the lower rectangular frame. A third frame linkage extends between the third lower pivot of the lower rectangular frame to the third upper pivot of the upper rectangular frame for pivoting the upper rectangular frame relative to the lower rectangular frame. A fourth frame linkage extends between the fourth lower pivot of the lower rectangular frame to the fourth upper pivot of the upper rectangular frame for pivoting the upper rectangular frame relative to the lower rectangular frame.

The first length, the second length, the third length, the fourth length, the first frame linkage, the second frame linkage, the third frame linkage and the fourth frame linkage define a parallelogram frame for pivoting the upper rectangular frame relative to the lower rectangular frame while retaining the upper rectangular frame parallel to the lower rectangular frame.

A body plate is positioned between the first frame linkage and the third frame linkage for supporting the body of the individual. A head plate is positioned within the upper rectangular frame for supporting the head of the individual. A drive engages between the lower rectangular frame and the parallelogram frame for displacing the body plate and the head plate for adjusting the height of the body and the head of the individual relative to the lower rectangular frame. The adjusting of the height of the body and the head of the individual relative to the lower rectangular frame aligns the upper airway.

In a more specific embodiment of the invention, the second lower pivot is inset to the first lower pivot for defining a first channel. The first channel permits the first frame linkage to be positioned adjacent to the second frame linkage for collapsing the parallelogram frame adjacent to the lower rectangular frame. The fourth lower pivot is inset to the third lower pivot for defining a second channel. The second channel permits the third frame linkage to be positioned adjacent to the fourth frame linkage for collapsing the parallelogram frame adjacent to the lower rectangular frame.

In a more specific embodiment of the invention, the drive includes a track positioned along the first lower side of the lower rectangular frame. A car pivotably engages the drive end of the drive linkage and slidably engages the track. A pneumatic cylinder is secured between the first lower side of the lower rectangular frame and said car for pivoting the parallelogram frame.

In one embodiment of the invention, the body plate includes a first pivot pin and a second pivot pin. A first polymeric disk and a second polymeric disk are positioned about the first pivot pin and the second pivot pin respectively. A first arm plate is pivotably secured to the first pivot of the body plate for supporting the first arm of the individual. A second arm plate is pivotably secured to the second pivot of the body plate for supporting the second arm of the individual. A first fastener engages the first pivot pin for compressing the first polymeric disk between the body plate and the first arm plate for resisting pivoting of the first arm plate relative to the body plate. A second fastener engages the second pivot pin for compressing the second polymeric disk between the body plate and the second arm plate for resisting pivoting of the second arm plate relative to the body plate.

In another embodiment of the invention, the upper rectangular frame includes a cradle frame extending below the upper rectangular frame. The cradle frame defines a front vertical member, a rear vertical member and a horizontal member extending between the front vertical member and the rear vertical member. The head plate includes a first head plate, a second head plate and a center head plate positioned between the first head plate and the second head plate. A head drive engages the horizontal member of the cradle frame and the center head plate for vertically displacing the center head plate for adjusting the height of the head of the individual relative to the head plate. By adjusting the height of the head relative to the head plate aligns the upper airway.

In another embodiment of the invention, the first arm plate includes a first cavity defining a first groove and a second groove. An extendable first arm plate slidably engages between the first groove and the second groove for extending the length of the first arm plate. The second arm plate includes a second cavity defining a third and fourth groove. An extendable second arm plate slidably engages between the third groove and the fourth groove for extending the length of said second arm plate.

In another embodiment of the invention, the support device comprises a base plate defining a top surface, a bottom surface, a front edge, a rear edge, a first side edge and a second side edge. A body plate defines a top surface, a bottom surface, a front edge, a rear edge, a first side edge and a second side edge for supporting the body of the individual. A first pivot pivotably secures the front edge of the base plate to the front edge of the body plate for inclining the body plate relative to the base plate. A head plate defines a top surface, a bottom surface, a front edge, a rear edge, a first side edge and a second side edge for supporting the head of the individual. A second pivot pivotably secures the front edge of the head plate to the rear edge of the body plate for permitting the head plate to pivot relative to the body plate. A lift extends between the top surface of the base plate and the bottom surface of the head plate for simultaneously adjusting the elevation of the head plate and the inclination of the body plate relative to the base plate. By adjusting the elevation of the head plate and the inclination of the body plate displaces the body and the head of the individual for aligning the upper airway.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
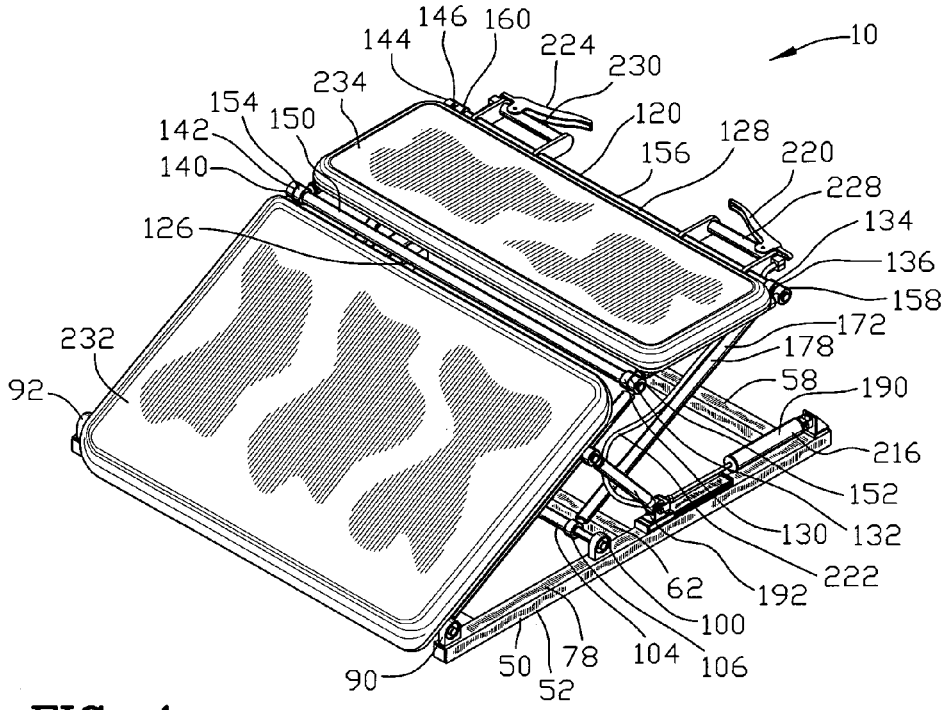
FIG. 1 is an isometric view of a first embodiment for a support device in an elevated position of the present invention.
Figure 2:
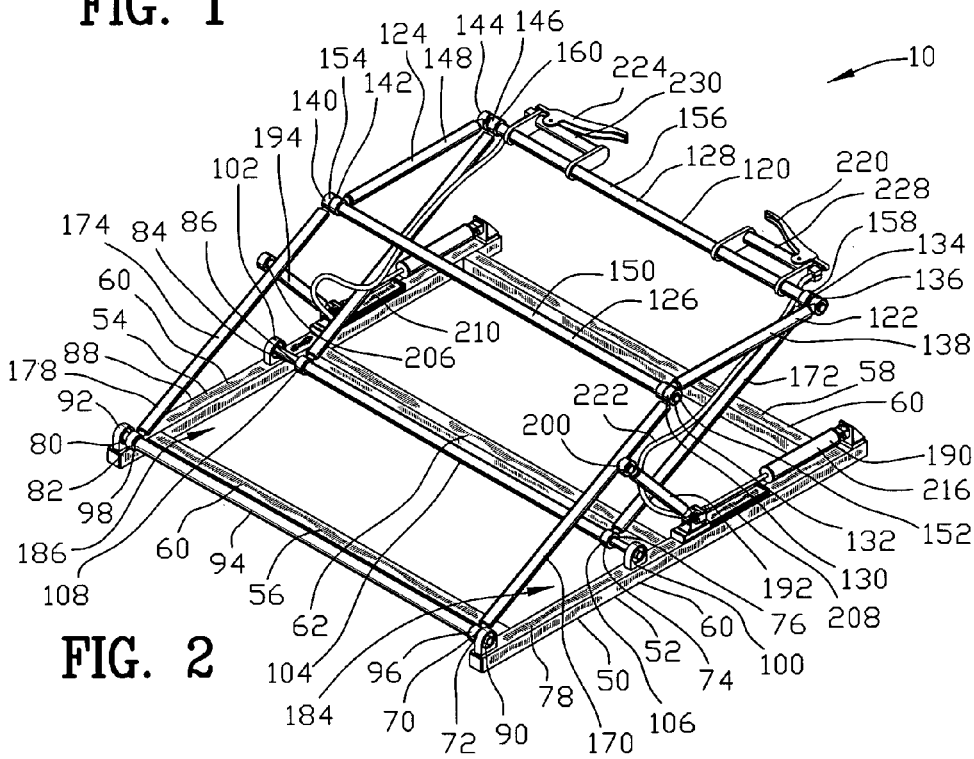
FIG. 2 is an isometric view similar to FIG. 1 illustrating the support device without a body plate and a head plate.
Figure 3:
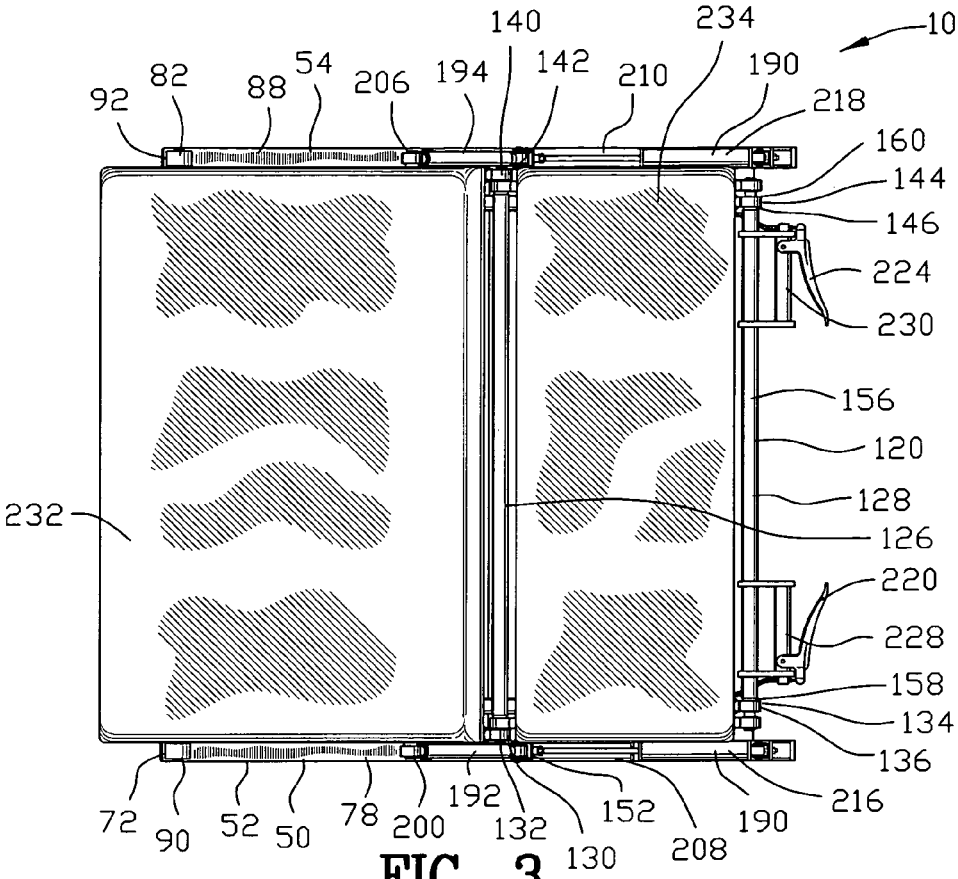
FIG. 3 is a top view of FIG. 1.
Figure 4:
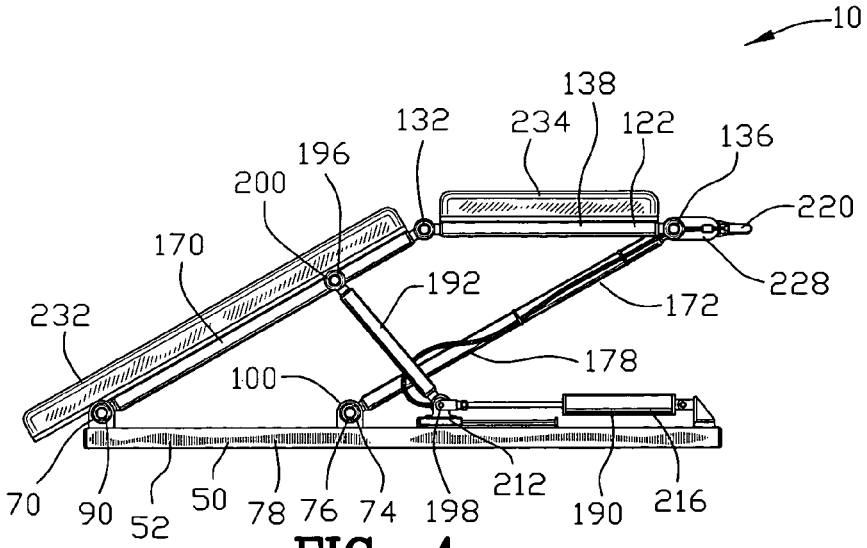
FIG. 4 is a side view of FIG. 4.
Figure 5:
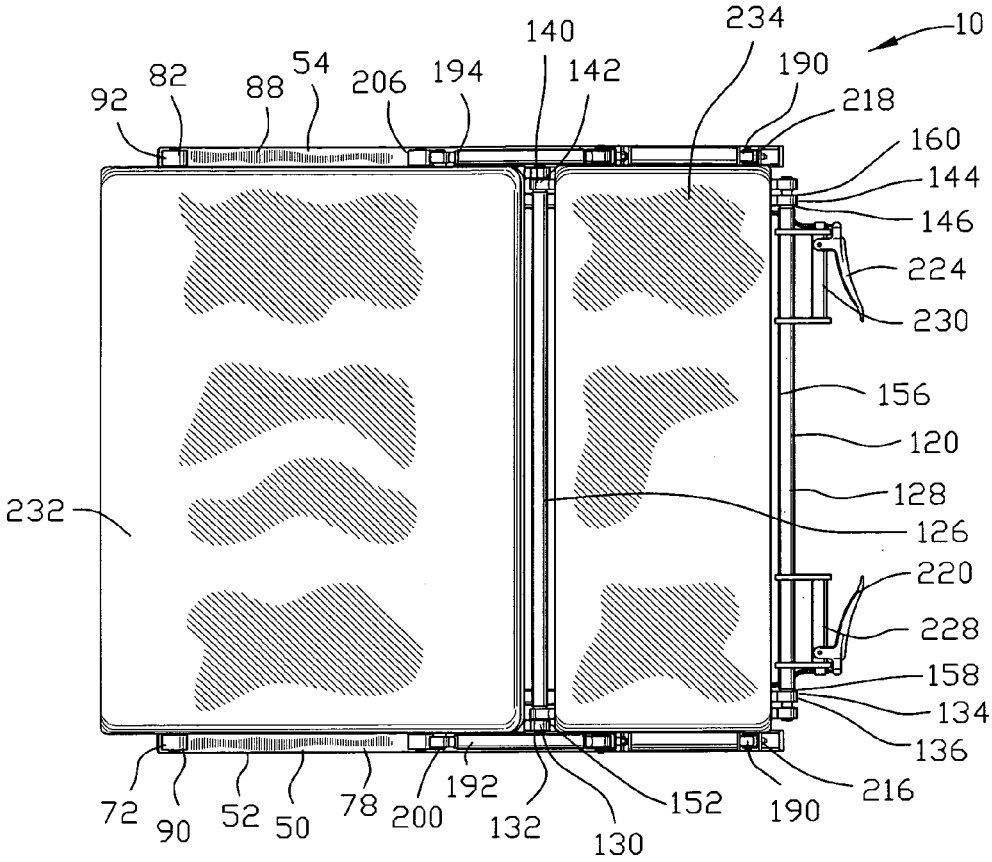
FIG. 5 is a top view similar to FIG. 3 illustrating the support device in a lowered position.
Figure 6:
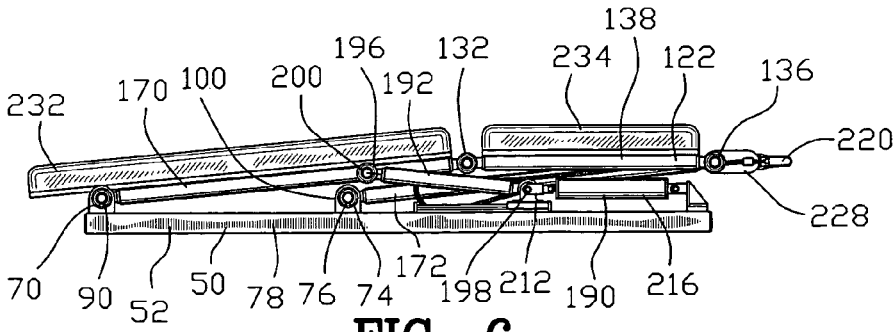
FIG. 6 is a side view of FIG. 5.
Figure 7:
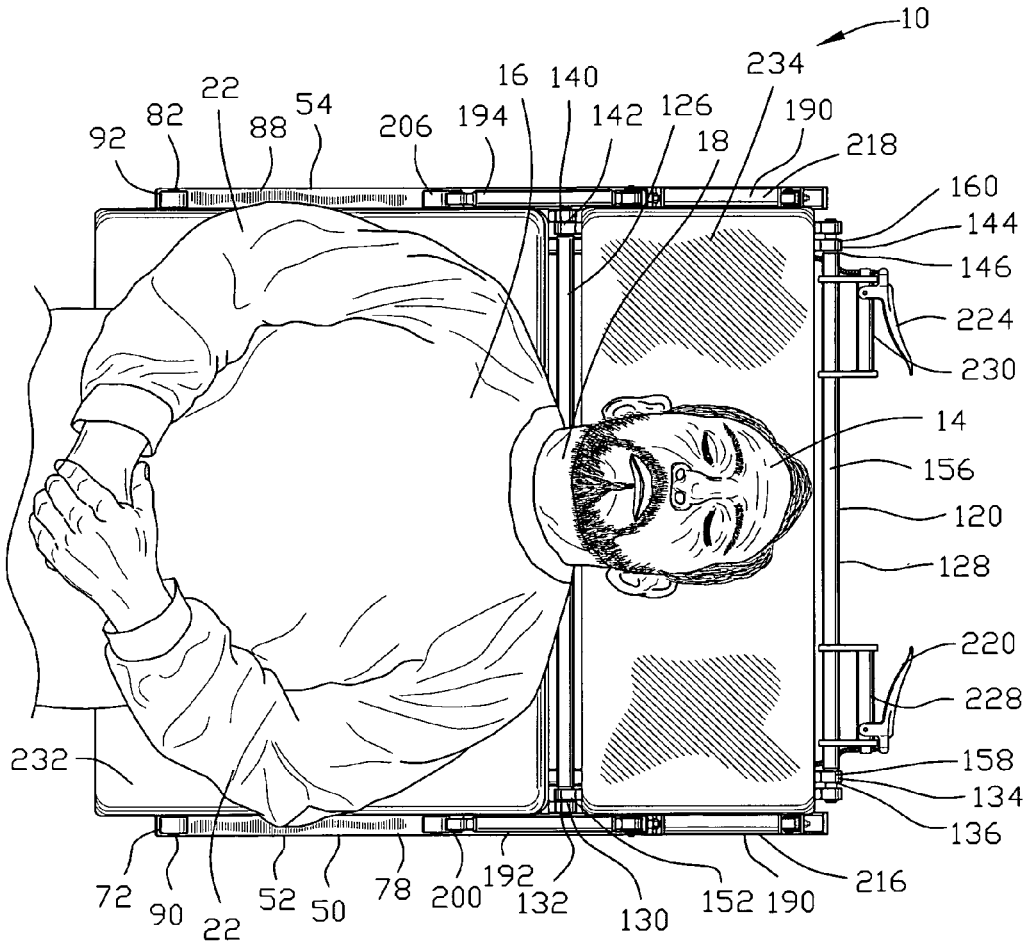
FIG. 7 is a top view similar to FIG. 5 illustrating an individual positioned on the support device.
Figure 8:
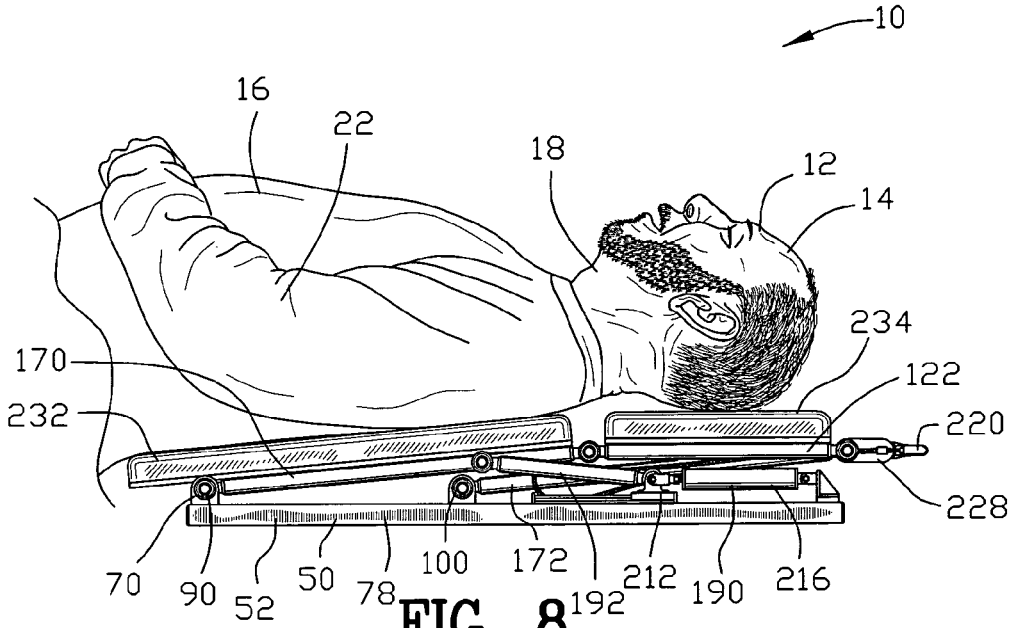
FIG. 8 is a side view of FIG. 7.
Figure 9:
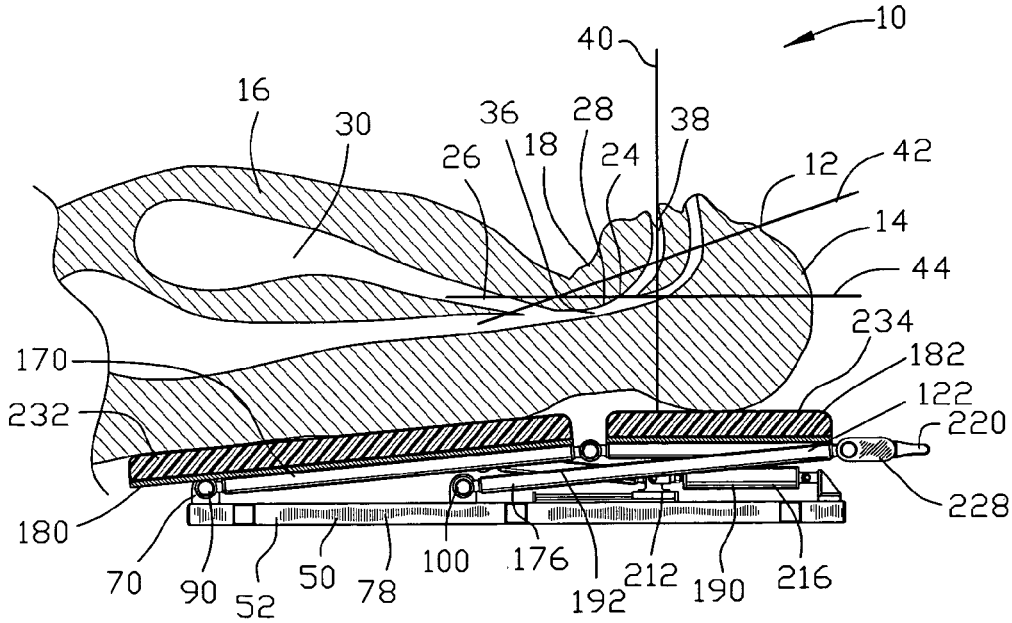
FIG. 9 is a sectional view along line 9-9 in FIG. 7.
Figure 10:
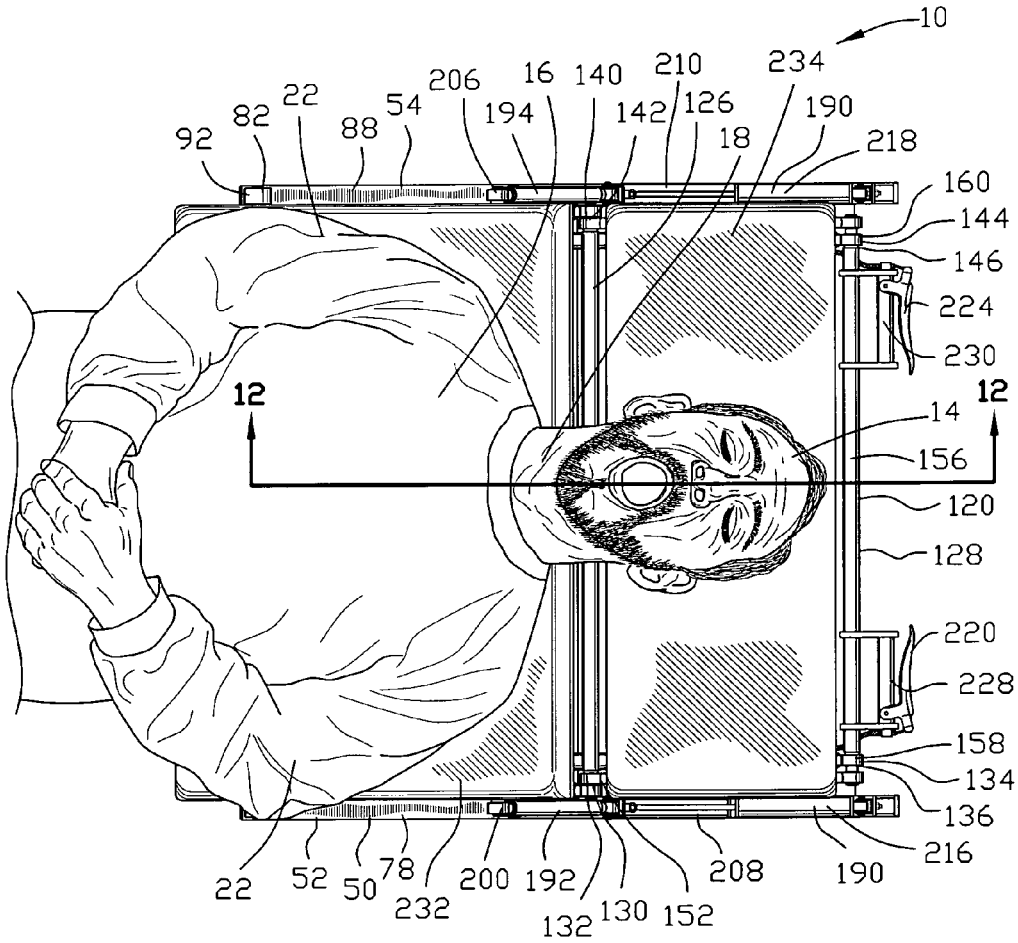
FIG. 10 is a top view similar to FIG. 7 illustrating the support device in an elevated position.
Figure 11:
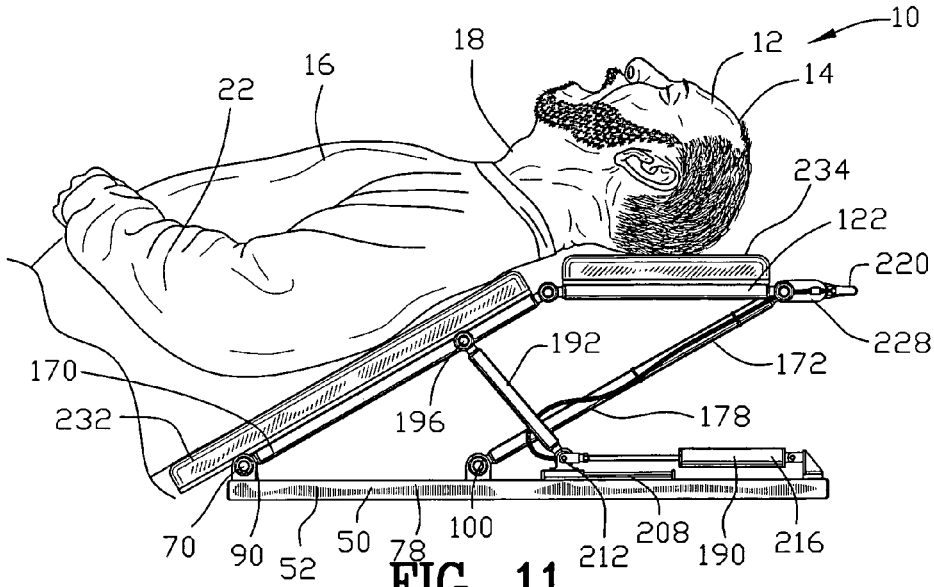
FIG. 11 is a side view of FIG. 10.
Figure 12:
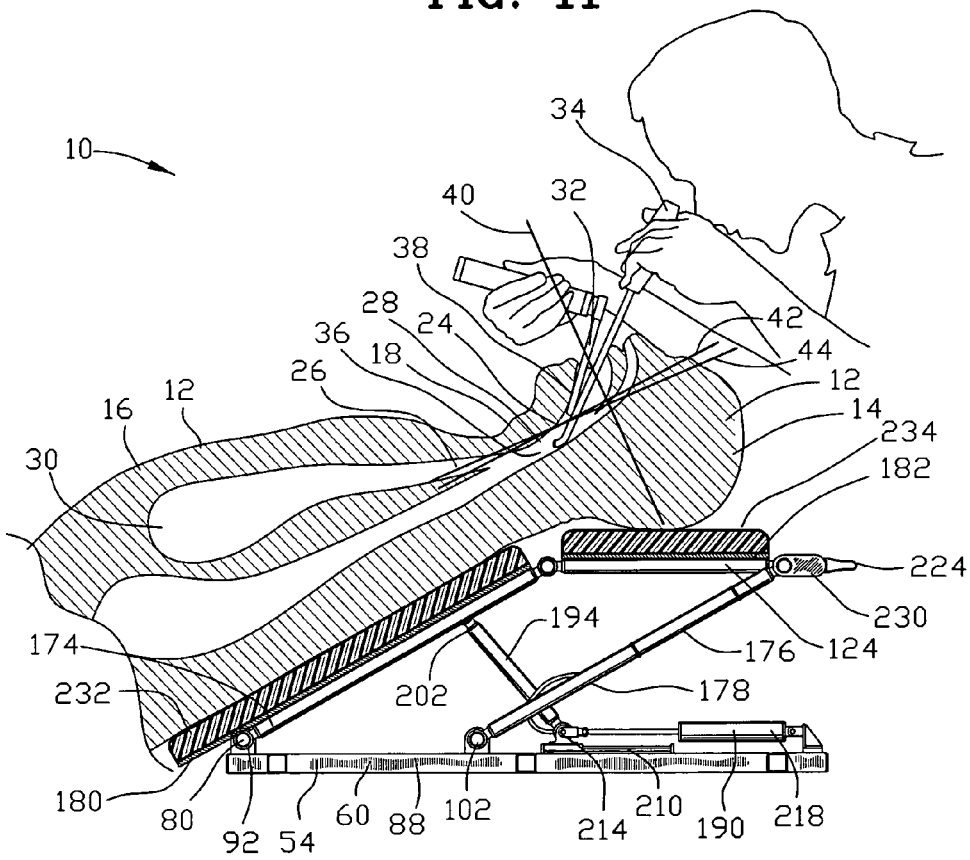
FIG. 12 is a sectional view along line 12-12 in FIG. 10 illustrating an upper airway aligned and the insertion of endotracheal tube.
Figure 13:
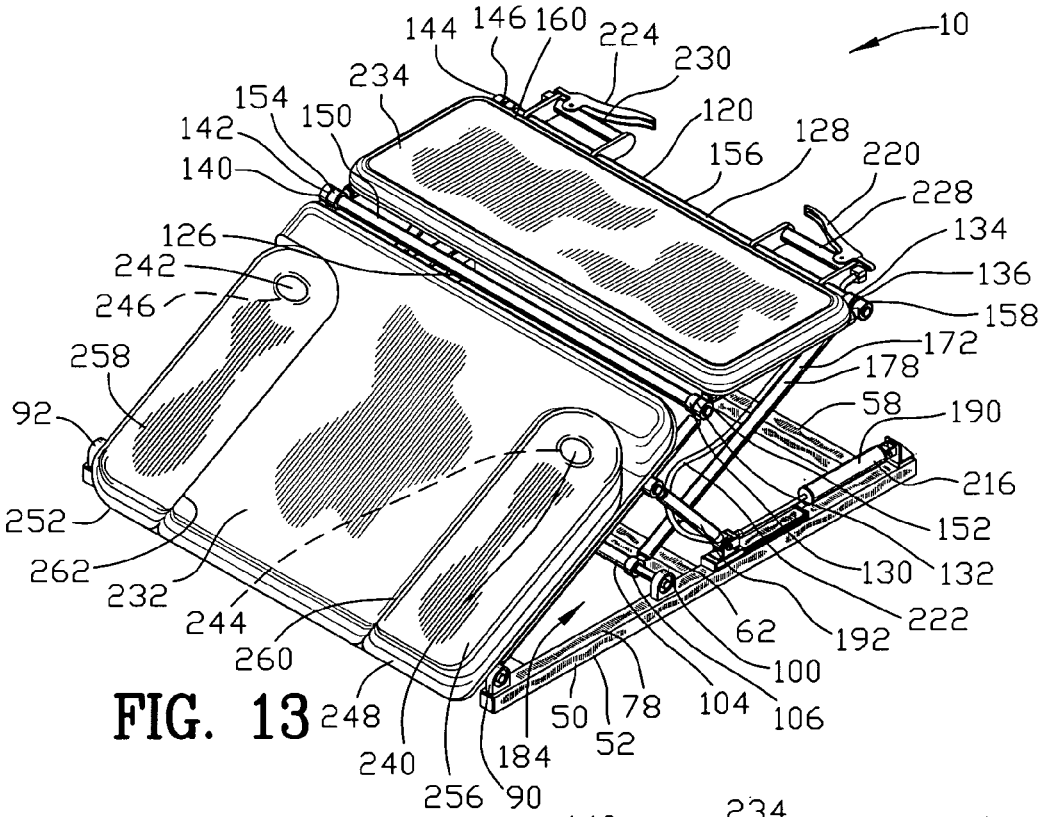
FIG. 13 is an isometric view similar to FIG. 1 illustrating a second embodiment of the support device.
Figure 14:
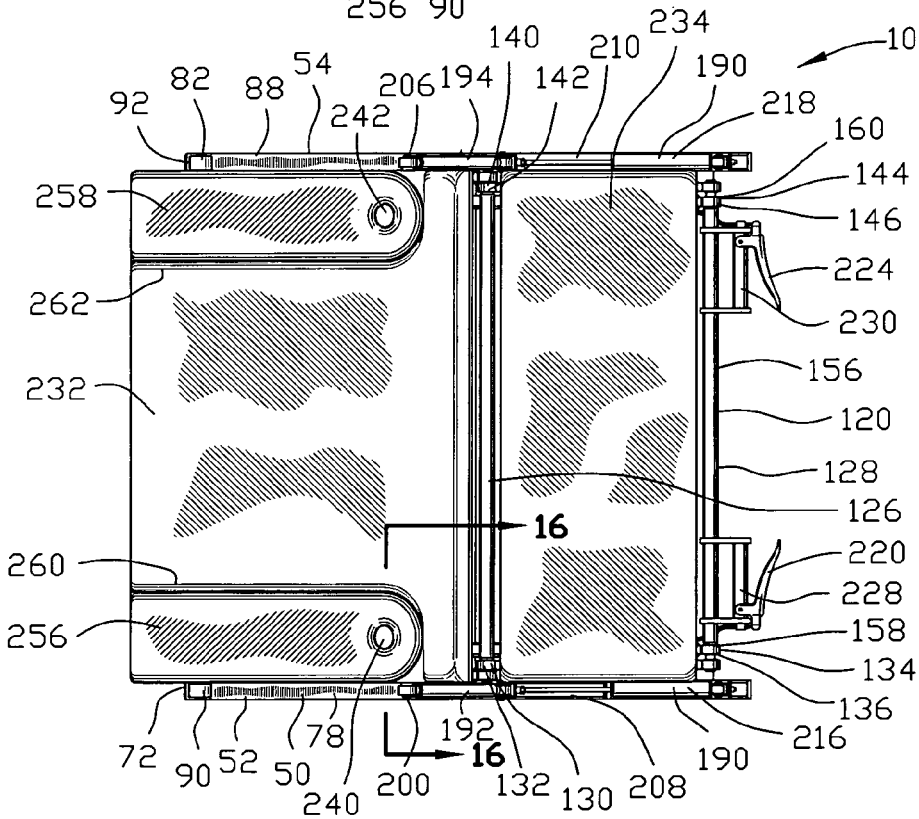
FIG. 14 is a top view of FIG. 13.
Figure 15:
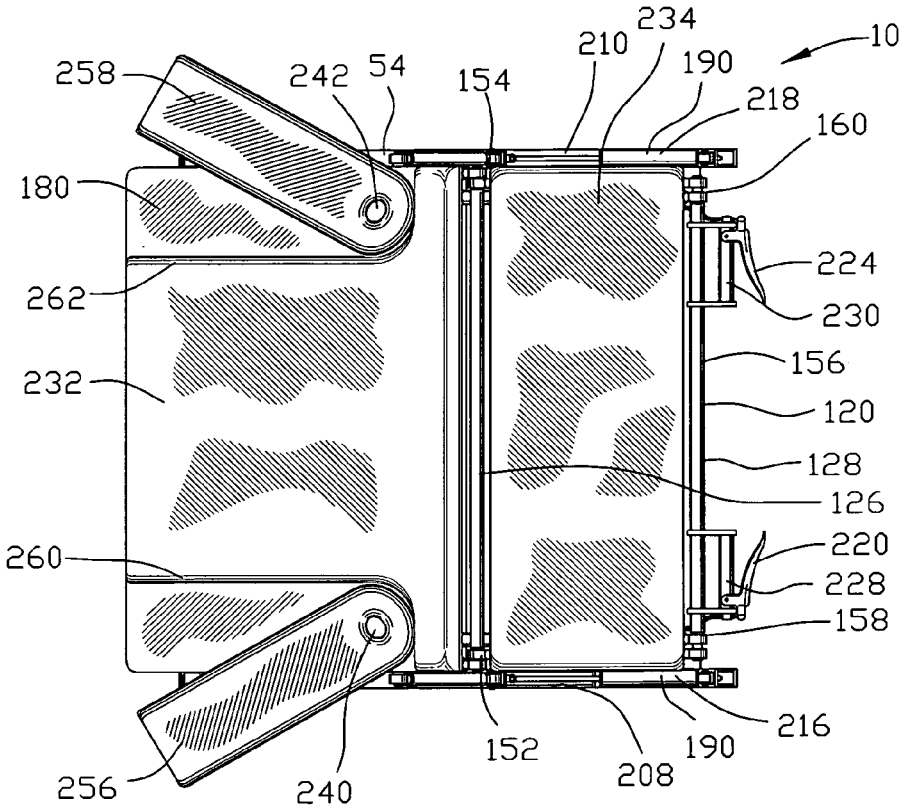
FIG. 15 is a top view similar to FIG. 14 illustrating a first arm plate and a second arm plate pivoting from the body plate.
Figure 16:
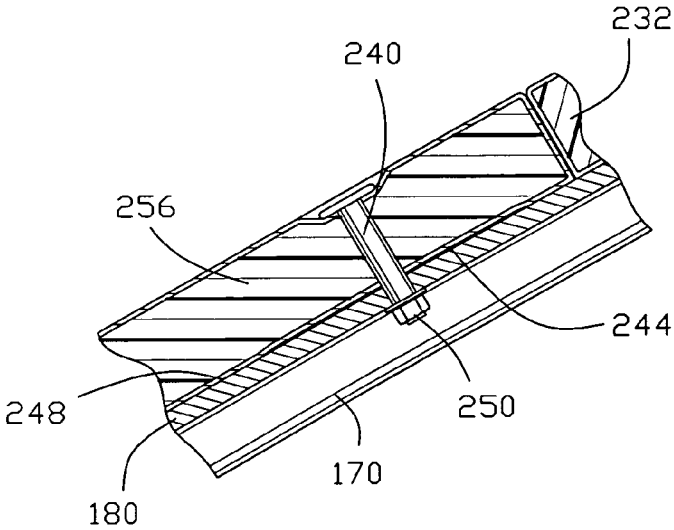
FIG. 16 is a sectional view along line 16-16 in FIG. 14.
Figure 17:
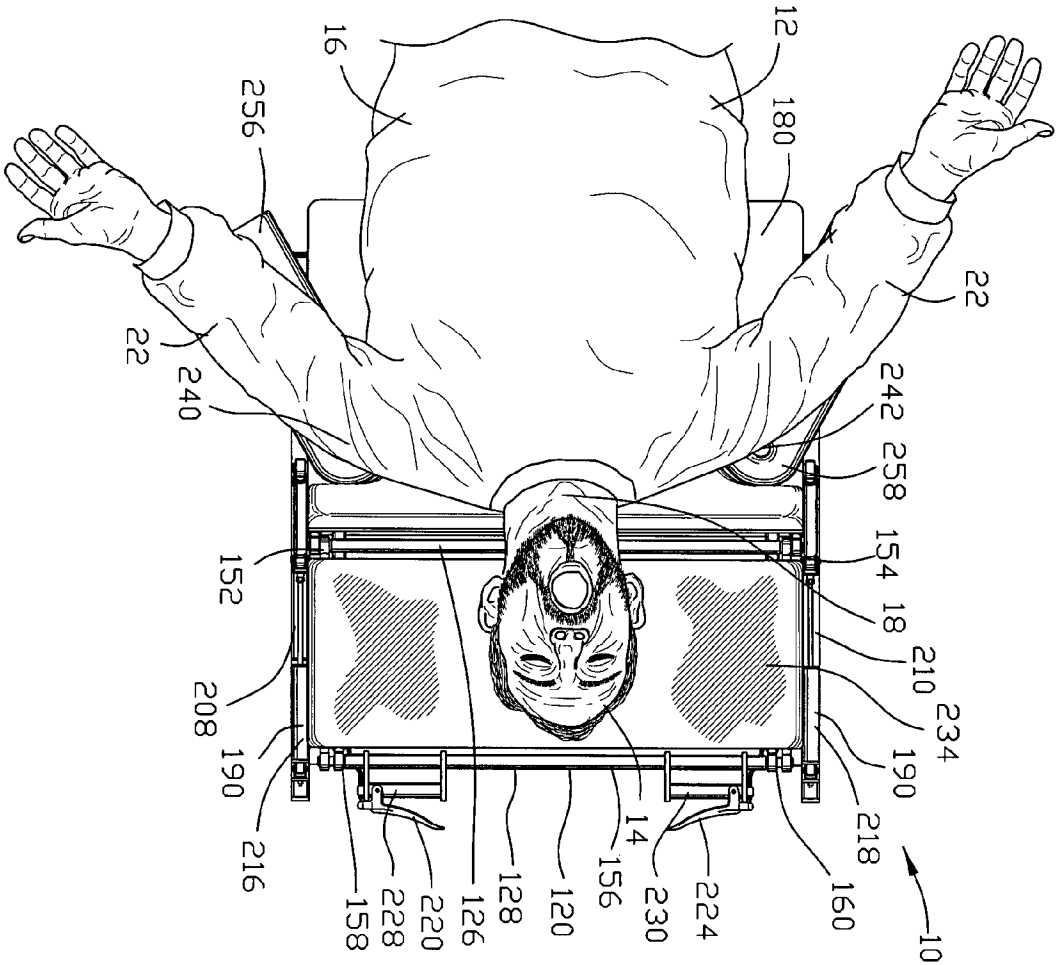
FIG. 17 is a top view similar to FIG. 15 illustrating the individual positioned on the support device.
Figure 18:
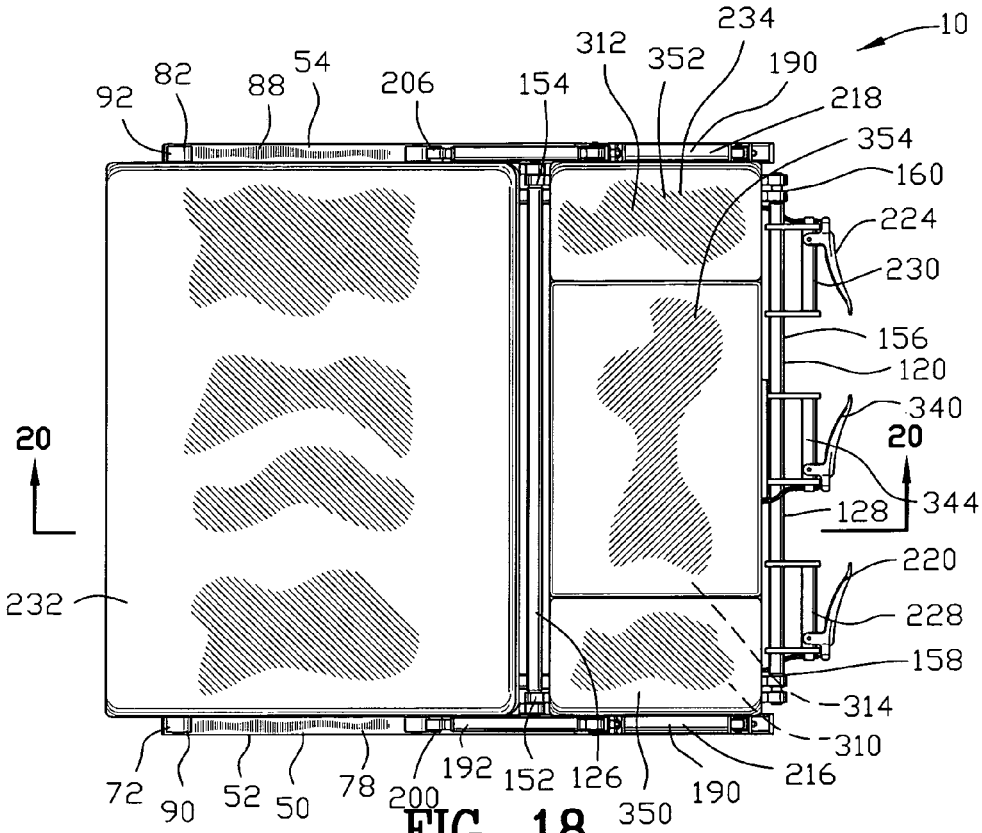
FIG. 18 is a top view similar to FIG. 5 illustrating a third embodiment of the support device.
Figure 19:
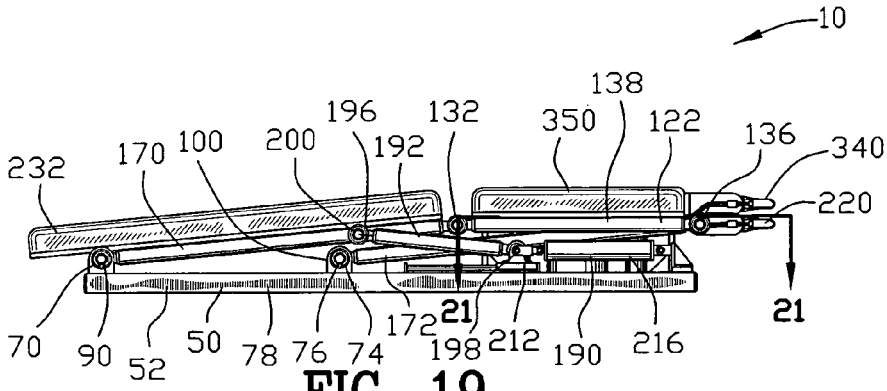
FIG. 19 is a side view of FIG. 18.
Figure 20:
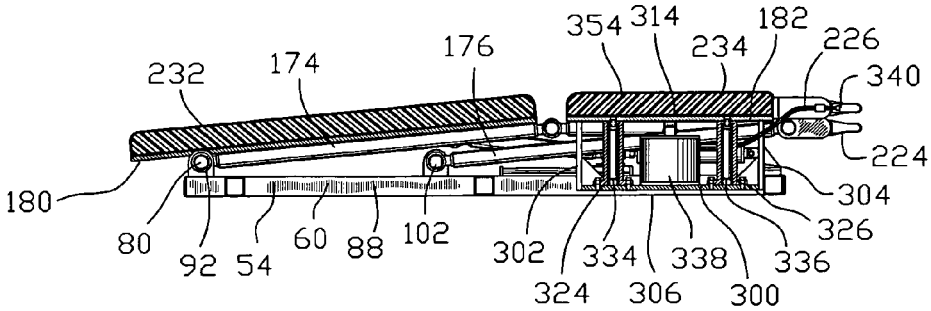
FIG. 20 is a sectional view along line 20-20 in FIG. 18.
Figure 21:
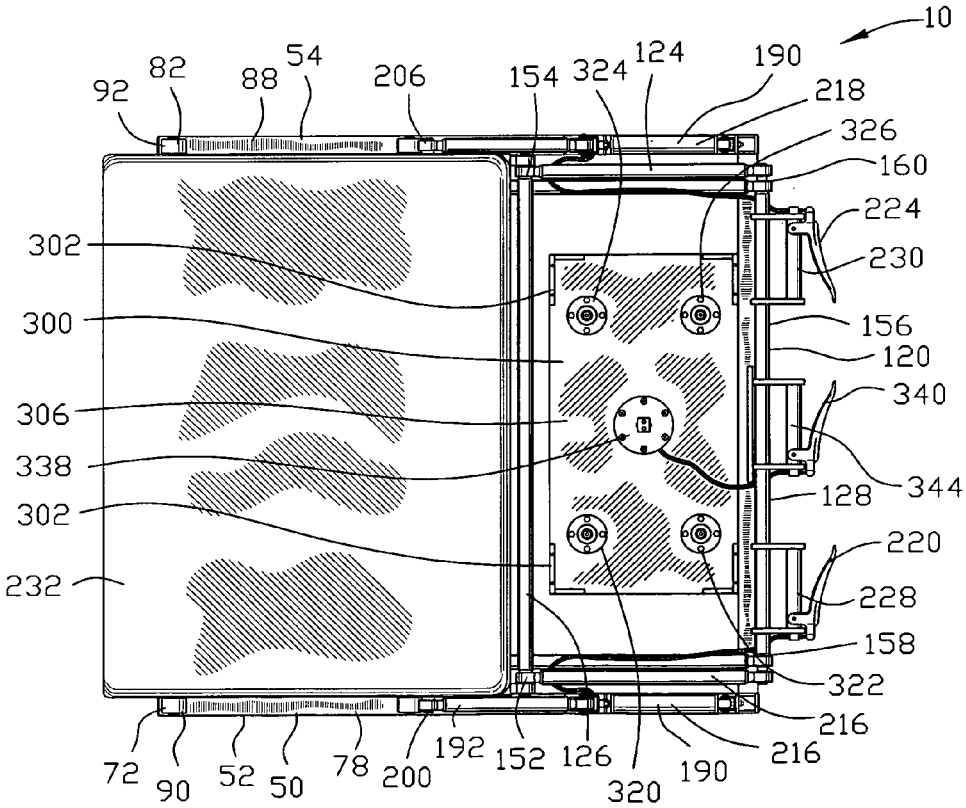
FIG. 21 is a top view similar to FIG. 18 including a sectional view along line 21-21 in FIG. 19.
Figure 22:
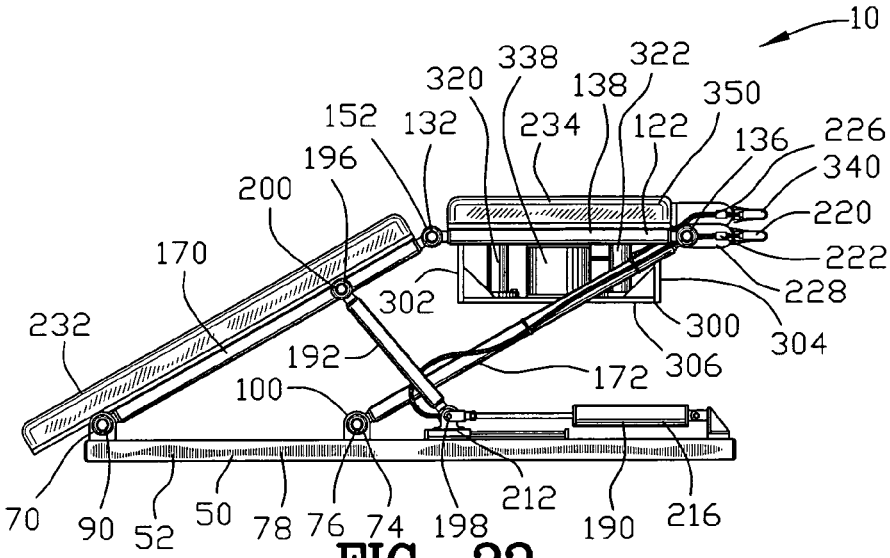
FIG. 22 is a side view similar to FIG. 19 illustrating the support device in an elevated position.
Figure 23:
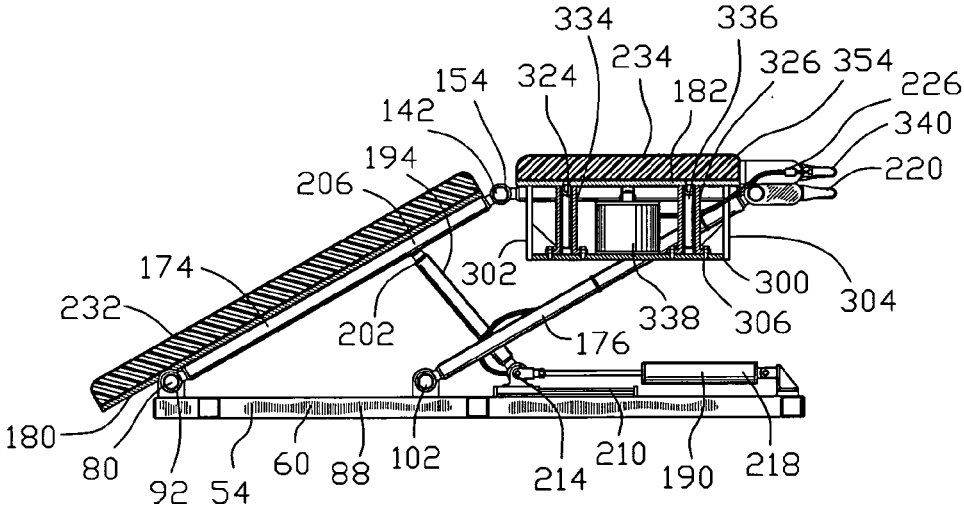
FIG. 23 is a sectional view similar to FIG. 20 illustrating the support device in an elevated position.
Figure 24:
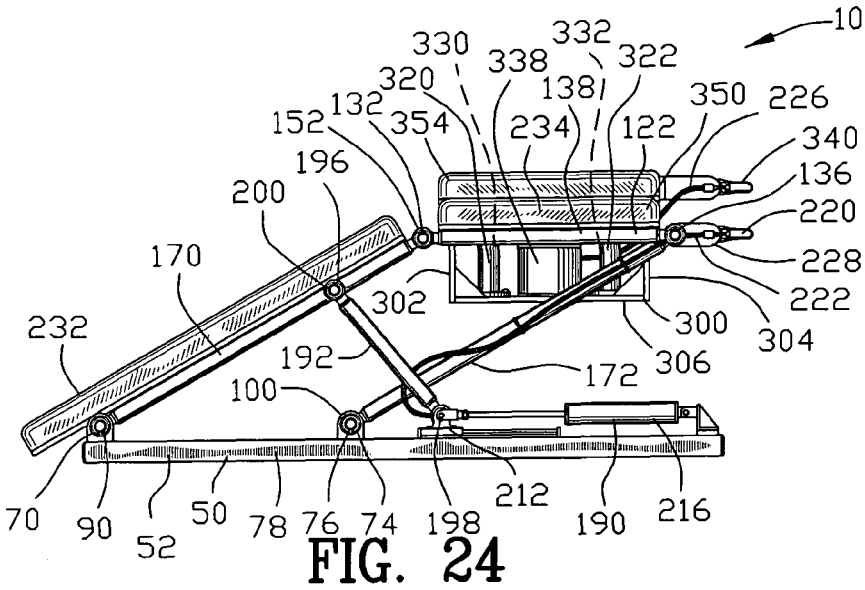
FIG. 24 is a side view similar to FIG. 22 illustrating a center head plate in an elevated position.
Figure 25:
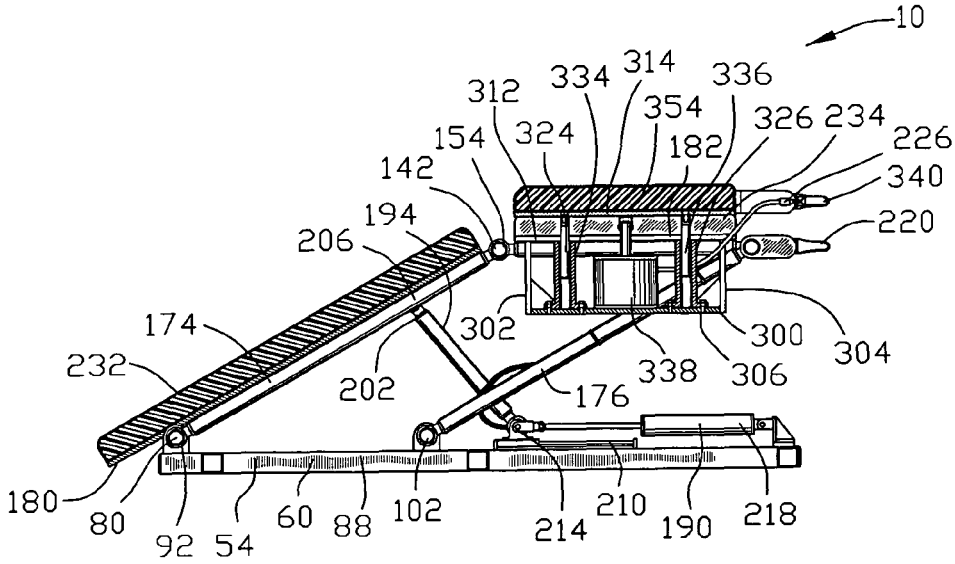
FIG. 25 is a sectional view similar to FIG. 23 illustrating the center head plate in an elevated position.
Figure 26:
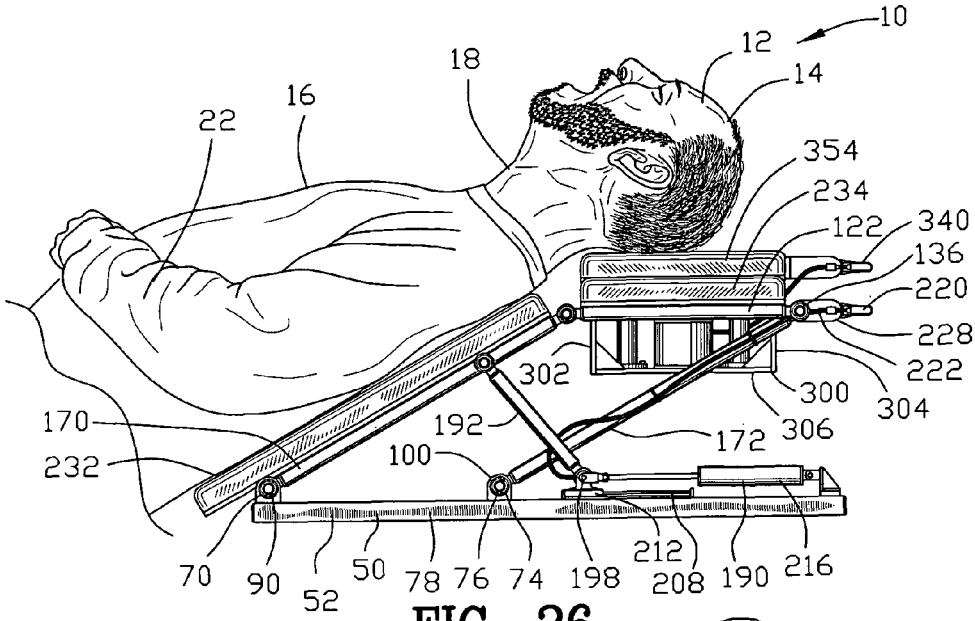
FIG. 26 is a side view similar to FIG. 24 illustrating the individual positioned on the support device.

FIGS. 1-12 are various views of a first embodiment of a support device 10 for positioning an individual 12 in an inclined orientation. The individual 10 is shown having a head 14 secured to a body 16 by a neck 18. A first arm 20 and a second arm 22 extending from the body 16. As best seen in FIGS. 9 and 12 the head 14 has an upper airway 24 and the body 16 has a lower airway 26 for delivering oxygen into the individual 10.

The support device 10 is shown utilized in conjunction with endotracheal intubation. Endotracheal intubation may be utilized during a surgical procedure for maintaining an unobstructed air passage 28 to and from the lungs 30. Many surgical procedures require the individual 10 to be placed in the supine position. As best seen in FIG. 9 the individual 10 placed in the supine position causes the upper airway 24 to restrict. This restriction of the upper airway 24 may be further limited where the individual 10 is obese. As such, during endotracheal intubation it is critical that the head 14 and body 16 be positioned in an appropriate manner for maintaining an unobstructed upper airway 24. In addition, during endotracheal intubation is critical that the head 14 and body 16 be positioned for permitting visualization and insertion of an endotracheal tube 32. By maintaining the head 14 and body 16 in an appropriate positioned greatly improves the oxygenation the individual 10. Where the individual 10 is obese, the positioning of the head 14 and body 16 during endotracheal intubation becomes extremely critical.

A doctor routinely utilizes a laryngoscope 32 that assists in viewing the trachea 36 and displaces the tongue 38 for insertion of the endotracheal tube 34. The endotracheal tube 34 maintains an unobstructed passage to and from the lungs 30 in order to oxygenate the individual 10. Preferably, the body 16 of the individual 10 is positioned 25° from a horizontal position and the head 14 is positioned in a horizontal position that is slightly elevated above the body 16. By maintaining the body 16 positioned at 25° and the head 14 positioned horizontal, greater control of the upper airway 24 is achieved, endotracheal intubation is simplified and oxygenation of the individual 10 is improved.

As best seen in FIGS. 1-12, the support device 10 comprises a lower rectangular frame 50 defines a first lower side 52, a second lower side 54, a front lower side 56 and a rear lower side 58. The first lower side 52, second lower side 54, front lower side 56 and rear lower side 58 are shown having a square cross section 60, however the first lower side 52, second lower side 54, front lower side 56 and rear lower side 58 may include other cross sections. The lower rectangular frame 50 may further include a lower cross member 62 for increasing the rigidity of the lower rectangular frame 50. The first lower side 52, second lower side 54, front lower side 56 and rear lower side 58 may be assembled by welding, fasteners or other securing means.

A first lower pivot 70 is secured to the first lower side 52 of the lower rectangular frame 50 at a first position 72. A second lower pivot 74 is secured to the first lower side 52 of the lower rectangular frame 50 at a second position 76. The first position 72 and the second position 76 define a first length 78 between the first position 72 and the second position 76. A third lower pivot 80 is secured to the second lower side 54 of the lower rectangular frame 50 at a third position 82. A fourth lower pivot 84 is secured to the second lower side 54 of the lower rectangular frame 50 at a fourth position 86. The third position 82 and the fourth position 86 define a second length 88 between the third position 82 and the fourth position 86. The first length 78 and the second length 88 having an equivalent dimension. The first position 72 and the third position 82 have a parallel alignment with the second position 76 and the fourth position 86.

The first lower pivot 70 and the third lower pivot 80 may include a first riser 90 secured to the first lower side 52 and a second riser 92 secured to the second lower side 54 respectively. A first rod 94 extends between the first riser 90 and the second riser 92. A first bearing 96 pivotably engages the first rod 94 and is positioned adjacent to first riser 90. A second bearing 98 also pivotably engages the first rod 94 and is positioned adjacent to the second riser 92.

The second lower pivot 74 and the fourth lower pivot 84 may include a third riser 100 secured to the first lower side 52 and a fourth riser 102 secured to the second lower side 54 respectively. A second rod 104 extends between the third riser 100 and the fourth riser 102. A third bearing 106 pivotably engages the second rod 104 and is positioned adjacent to the third riser 100. A fourth bearing 108 pivotably engages the second rod 104 and is positioned adjacent to the fourth riser 102.

An upper rectangular frame 120 defines a first upper side 122, a second upper side 124, a front upper side 126 and a rear upper side 128. A first upper pivot 130 is secured to the first upper side 122 of the upper rectangular frame 120 at a fifth position 132. A second upper pivot 134 is secured to the first upper side 122 of the upper rectangular frame 120 at a sixth position 136. The fifth position 132 and the sixth position 136 define a third length 138 between the fifth position 132 and the sixth position 136. A third upper pivot 140 is secured to the second upper side 124 of the upper rectangular frame 120 at a seventh position 142. A fourth upper pivot 144 is secured to the second upper side 124 of the upper rectangular frame 120 at an eighth position 146. The seventh position 142 and the eighth position 146 define a fourth length 148 between the seventh position 142 and the eighth position 146. The third length 138 and the fourth length 148 have an equivalent dimension. The fifth position 132 and the seventh position 142 have a parallel alignment with the sixth position 136 and the eighth position 146.

The first upper side 122 may include a front upper rod 150 extending between the fifth position 132 and the seventh position 142. A fifth bearing 152 pivotably engages the front upper rod 150 at the fifth position 132. A seventh bearing 154 pivotably engages the front upper rod 150 at the seventh position 142. The rear upper side 128 may include a rear upper rod 156 extending between the sixth position 136 and the eighth position 146. A sixth bearing 158 pivotably engages the rear upper rod 156 at the sixth position 136. A eighth bearing 160 pivotably engages the rear upper rod 156 at the eighth position 146.

A first frame linkage 170 extends between the first lower pivot 70 of the lower rectangular frame 50 to the first upper pivot 130 of the upper rectangular frame 120 for pivoting the upper rectangular frame 120 relative to the lower rectangular frame 50. A second frame linkage 172 extends between the second lower pivot 74 of the lower rectangular frame 50 to the second upper pivot 124 of the upper rectangular frame 120 for pivoting the upper rectangular frame 120 relative to the lower rectangular frame 50. A third frame linkage 174 extends between the third lower pivot 80 of the lower rectangular frame 50 to the third upper pivot 140 of the upper rectangular frame 120 for pivoting the upper rectangular frame 120 relative to the lower rectangular frame 50. A fourth frame linkage 176 extends between the fourth lower pivot 84 of the lower rectangular frame 50 to the fourth upper pivot 144 of the upper rectangular frame 120 for pivoting the upper rectangular frame 120 relative to the lower rectangular frame 50.

The first length 78, the second length 88, the third length 138, the fourth length 148, the first frame linkage 170, the second frame linkage 172, the third frame linkage 174 and the fourth frame linkage 176 define a parallelogram frame 178 for pivoting the upper rectangular frame 120 relative to the lower rectangular frame 50 while retaining the upper rectangular frame 120 parallel to the lower rectangular frame 50.

A body plate 180 is positioned between the first frame linkage 170 and the third frame linkage 174 for supporting the body 16 of the individual 12. A head plate 182 is positioned within the upper rectangular frame 120 for supporting the head 14 of the individual 12. The lower rectangular frame 50, upper rectangular frame 120, parallelogram frame 178 body plate 180 and head plate 182 may be constructed from steel, aluminum, polymeric or other rigid materials.

The second lower pivot 74 is inset to the first lower pivot 70 and the second upper pivot 134 is inset to the first upper pivot 130 for defining a first channel 184. The first channel 184 permits the first frame linkage 170 to be positioned adjacent to the second frame linkage 172 for collapsing the parallelogram frame 178 adjacent to the lower rectangular frame 50. The fourth lower pivot 84 is inset to the third lower pivot 80 and the fourth upper pivot 144 is inset to the third upper pivot 140 for defining a second channel 186. The second channel 186 permits the third frame linkage 174 to be positioned adjacent to the fourth frame linkage 176 for collapsing the parallelogram frame 178 adjacent to said lower rectangular frame 50.

A drive 190 engages between the lower rectangular frame 50 and the parallelogram frame 178 for displacing the body plate 180 and the head plate 182 for adjusting the height of the body 16 and the head 14 of the individual 12 relative to the lower rectangular frame 50. The adjusting of the height of the body 16 and the head 14 of the individual 12 relative to the lower rectangular frame 50 aligns the upper airway 24.

More specifically the drive 190 further includes a first drive linkage 192 and a second drive linkage 194. The first drive linkage 192 extends from the first frame linkage 170 to the first lower side 52 of the lower rectangular frame 50. The first drive linkage 192 extends from a frame end 196 to a drive end 198. A first frame pivot 200 is secured to the first frame linkage 170 for pivotably coupling the frame end 196 of the first drive linkage 192 to the parallelogram frame 178.

The second drive linkage 194 extends from the third frame linkage 174 to the second lower side 54 of the lower rectangular frame 50. The third drive linkage 172 extends from a second frame end 202 to a second drive end 204. A second frame pivot 206 is secured to the third frame linkage 174 for pivotably coupling the second frame end 202 of the third drive linkage 174 to the parallelogram frame 178. A first track 208 is positioned along the first lower side 52 of the lower rectangular frame 50. A second track 210 is positioned along the second lower side 54 of the lower rectangular frame 50. A first car 212 pivotably engages the drive end 198 of the first drive linkage 192 and slidably engages the length of the first track 208. A second car 214 pivotably engages the second drive end 204 of the second drive linkage 194 and slidably engages the length of the second track 210. A first pneumatic cylinder 216 is secured between the first lower side 52 of the lower rectangular frame 50 and the first car 212. A second pneumatic cylinder 218 is secured between the second lower side 54 of the lower rectangular frame 50 and the second car 214. The first pneumatic cylinder 216 propels the first car 212 along the first track 208. Movement of the first car 212 displaces the first drive linkage 192 for pivoting the parallelogram frame 178. The second pneumatic cylinder 218 propels the second car 214 along the second track 210. Movement of the second car 214 displaces the second drive linkage 194 for pivoting the parallelogram frame 178. The first and second pneumatic cylinders 216 and 218 may include a Stabilus gas spring cylinder having springs for lift assist, lock-in-position and dampening ergonomic motion. The first and second pneumatic cylinders 216 and 218 may also include other gas spring cylinders.

A first actuator 220 is secured to the rear upper side 128 of the upper rectangular frame 120. The first actuator 220 activates the first pneumatic cylinder 218 by a first cable linkage 222 extending between the first actuator 220 and the first pneumatic cylinder 216. A second actuator 224 is secured to the rear upper side 128 of the upper rectangular frame 120. The second actuator 224 activates the second pneumatic cylinder 218 by a second cable linkage 226 extending between the second actuator 224 and the second pneumatic cylinder 218. The first actuator 220 includes a first handle 228 where a vertical and a horizontal force may be applied to the upper rectangular frame 120 for assisting and controlling the pivoting of the upper rectangular frame 120 relative to the lower rectangular frame 50. The second actuator 224 includes a second handle 230 where a vertical and a horizontal force may be applied to the upper rectangular frame 120 for assisting and controlling the pivoting of the upper rectangular frame 120 relative to the lower rectangular frame 50.

The body plate 180 may include a body cushion layer 232 for padding the body 16 of the individual 12. Furthermore, the head plate 182 may include a head cushion layer 234 for padding the head 14 of the individual 12.

Preferably, the body plate 180 should be positioned 25° from the lower rectangular frame 50 for positioning the body 16 of the individual 10 25° from the lower rectangular frame 50. The head plate 182 should be maintained in a horizontal position for positioning the head 14 of the individual 10 in a horizontal position. By maintaining the body 16 positioned at 25° and the head 14 positioned horizontal, greater control of the upper airway 24 is achieved, endotracheal intubation is simplified and oxygenation of the individual 10 is improved.

FIGS. 13-17 and 28-31 are various views of a second embodiment of a support device 10 for displacing the first arm 20 and the second arm 22 of the individual 12 from the body 16. The body plate 180 includes a first pivot pin 240 and a second pivot pin 242. A first polymeric disk 244 and a second polymeric disk 246 are positioned about the first pivot pin 240 and the second pivot pin 242 respectively. A first arm plate 248 is positioned about the first pivot pin 240. A first fastener 250 engages the first pivot pin 240 for compressing the first polymeric disk 244 between the body plate 180 and the first arm plate 248. The friction between the first polymeric disk 244 and both the first arm plate 248 and the body plate 180 resists pivoting of the first arm plate 248 relative to the body plate 180. The first arm plate 248 permits the first arm 20 of the individual 12 to be displaced from the body 16. Similarly, a second arm plate 252 is positioned about the second pivot pin 242. A second fastener 254 engages the second pivot pin 242 for compressing the second polymeric disk 246 between the body plate 180 and the second arm plate 252. The friction between the second polymeric disk 246 and both the second arm plate 252 and the body plate 180 resists pivoting of the second arm plate 252 relative to the body plate 180. The second arm plate 252 permits the second arm 22 of the individual 12 to be displaced from the body 16.

The first arm plate 248 may include a first arm cushion 256 for padding the first arm 20 of the individual 12. Similarly, the second arm plate 252 may include a second arm cushion 258 for padding the second arm 22 of the individual 12. Preferably, the body cushion layer 232 includes a first notch 260 for receiving the first arm plate 248 and the first arm cushion 256. Furthermore, the depth of the body cushion layer 232 is preferably equivalent to the first arm cushion 256 for creating flat surface upon the first arm plate 248 pivoting into the body plate 180. The body cushion layer 232 may further include a second notch 262 for receiving the second arm plate 252 and the second arm cushion 258. Furthermore, the depth of the body cushion layer 232 is preferably equivalent to the second arm cushion 258 for creating flat surface upon the second arm plate 252 pivoting into the body plate 180.

As best seen in FIGS. 30-33 the first arm plate 248 may include a first cavity 270 defining a first groove 272 and a second groove 274. An extendable first arm plate 276 slidably engages between the first groove 272 and the second groove 274 for extending the length of the first arm plate 248. Similarly, the second arm plate 252 may include a second cavity 278 defining a third groove 280 and a fourth groove 282. An extendable second arm plate 284 slidably engages between the third groove 280 and the fourth groove 282 for extending the length of the second arm plate 252. The extendable first arm plate 276 and the extendable second arm plate 284 may have a first grip 286 and a second grip 288 respectively for permitting rasping of the extendable first arm plate 276 and the extendable second arm plate 284.

A third arm cushion 290 may be secured to the extendable first arm plate 276 wherein the third arm cushion engages within the first cavity 270. The third arm cushion 290 further pads the first arm 20 of the individual 12. A fourth arm cushion 292 may be secured to the extendable second arm plate 284 wherein the fourth arm cushion 292 engages within the second cavity 278. The fourth arm cushion 292 further pads the second arm 22 of the individual 12.

FIGS. 18-27 are various views of a second embodiment of a support device 10 for positioning an individual 12 in an inclined orientation. The upper rectangular frame 120 includes a cradle frame 300 extending below the upper rectangular frame 120. The cradle frame 300 defining a front vertical member 302, a rear vertical member 304 and a horizontal member 306 extending between the front vertical member 302 and the rear vertical member 304. The head plate 182 further includes a first head plate 310, a second head plate 312 and a center head plate 314 positioned between the first head plate 310 and the second head plate 312. A head drive 316 engages the horizontal member 306 of the cradle frame 300 and the center head plate 314 for vertically displacing the center head plate 314 for adjusting the height of the head 14 of the individual 12 relative to the head plate 182.

For maintaining a vertical alignment between the center head plate 314 and the cradle frame 300, the cradle frame 300 includes a first vertical cylinder 320, a second vertical cylinder 322, a third vertical cylinder 324 and a fourth vertical cylinder 326 extending from the horizontal member 306 of the cradle frame 300. A first vertical rod 330, a second vertical rod 332, a third vertical rod 334, and a fourth vertical rod 336 extend from the center head plate 314. The first vertical rod 330, the second vertical rod 332, the third vertical rod 334 and the fourth vertical rod 336 slidably engaging into the first vertical cylinder 320, the second vertical cylinder 322, the third vertical cylinder 324 and the fourth vertical cylinder 326 respectively for maintaining a vertical alignment between the center head plate 314 and the cradle frame 300.

The head drive 316 may include a third pneumatic cylinder 338. More specifically, the head drive 316 may include a Stabilus gas spring cylinder having springs for lift assist, lock-in-position and dampening ergonomic motion. The head drive 316 may also include other gas spring cylinders.

A head drive actuator 340 is secured to the center head plate 314. The head drive actuator 340 activates the third pneumatic cylinder 338 by a third cable linkage 342 extending between the head drive actuator 340 and the third pneumatic cylinder 338. The head drive actuator 340 includes a third handle 344 where a vertical and a horizontal force may be applied to the center head plate 314 for assisting and controlling the vertical height of the center head plate 314 relative to the upper rectangular frame 120.

A first head cushion layer 350, a second head cushion layer 352 and a center head cushion layer 354 are secured to the first head plate 310, the second head plate 312 and the center head plate 314 respectively for padding the head 14 of the individual 12. Preferably, the depth of the first head cushion layer 350, the second head cushion layer 352 and the center head cushion layer 354 are equivalent for creating a flat surface upon the body cushion layer 232 is preferably equivalent to the first arm cushion 256 for creating flat surface upon the center head plate 314 positioned adjacent to the first head plate 310 and the second head plate 312.

Figure 27:
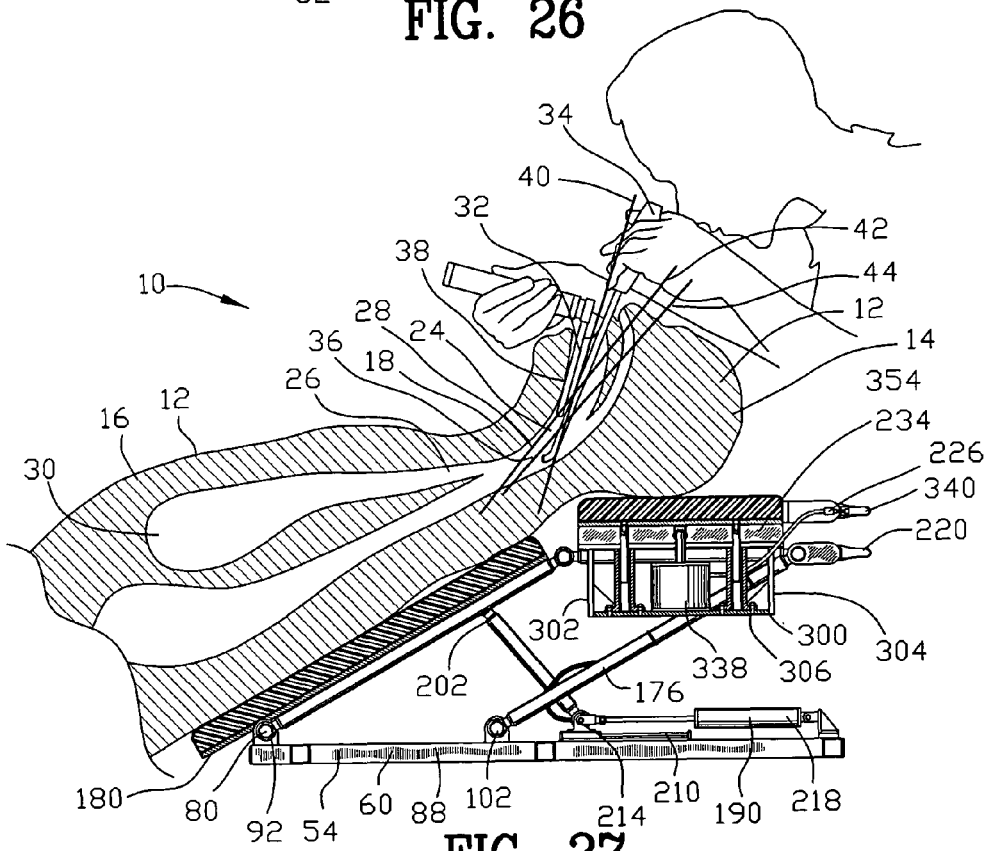
FIG. 27 is a sectional view similar to FIG. 25 illustrating an upper airway aligned and the insertion of endotracheal tube.
Figure 28:
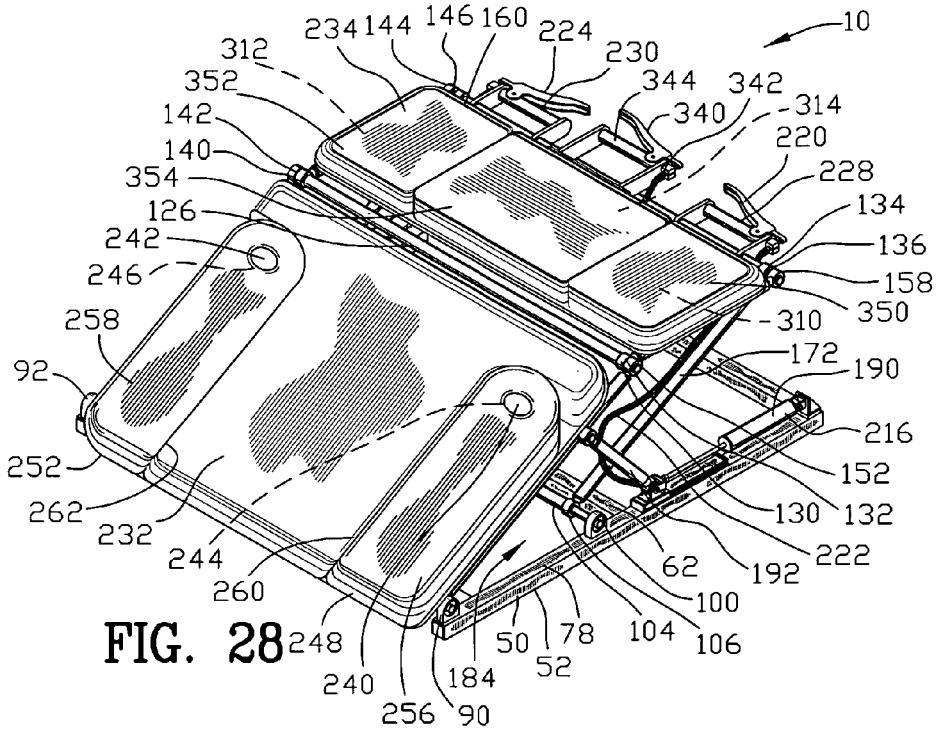
FIG. 28 is an isometric view similar to FIG. 13 illustrating a fourth embodiment of the support device.
Figure 29:
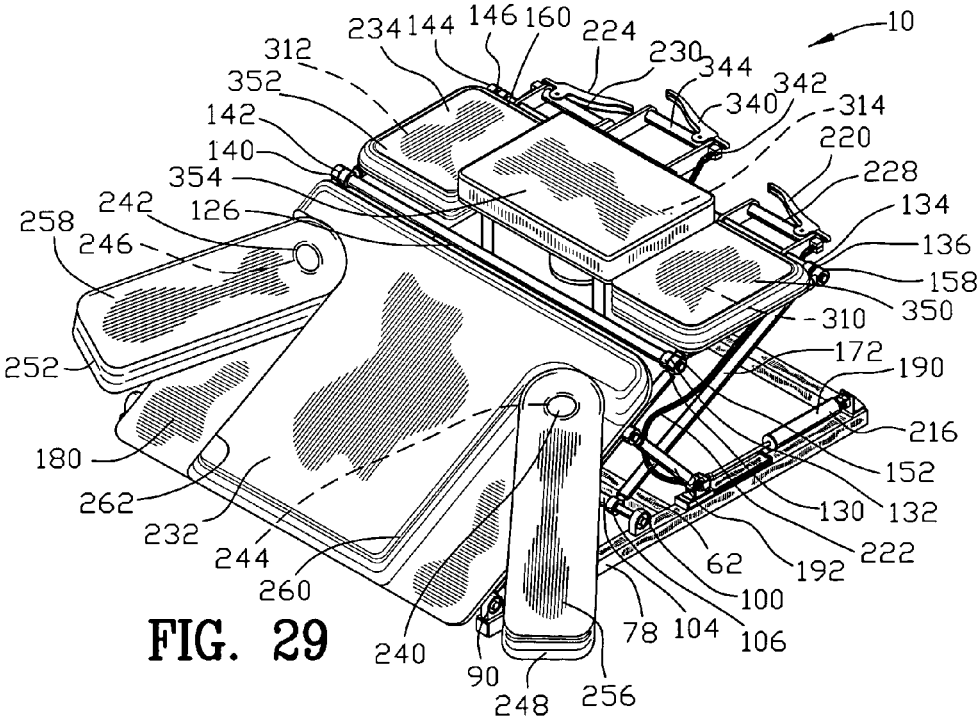
FIG. 29 is an isometric view similar to FIG. 28 illustrating the first arm plate and the second arm plate pivoting from the body plate and the center head plate in an elevated position.
Figure 30:
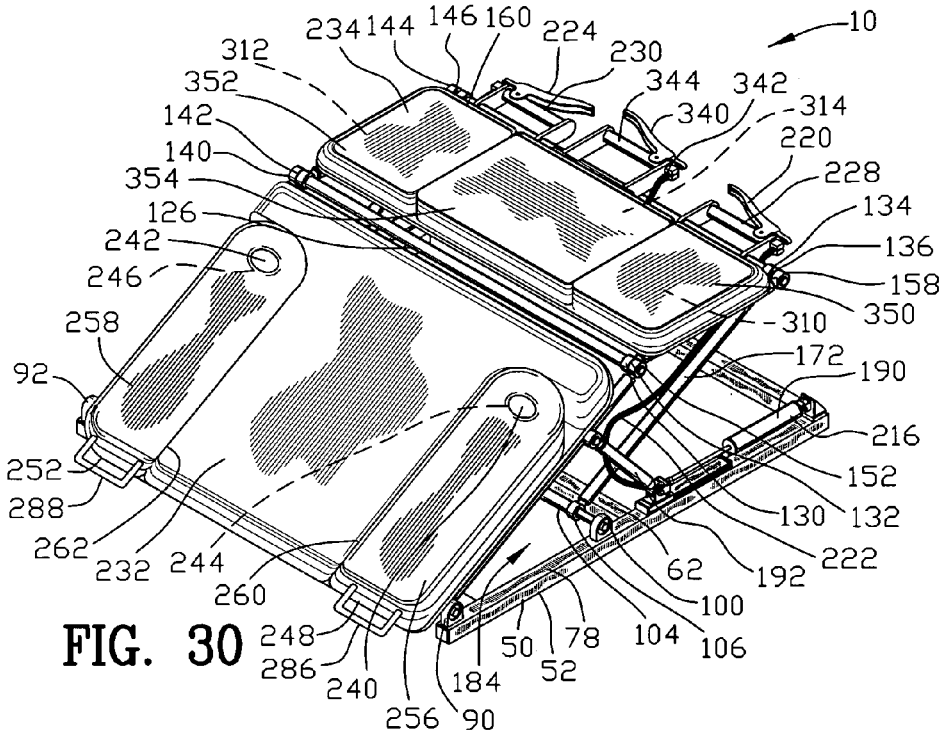
FIG. 30 is an isometric view similar to FIG. 28 illustrating a fifth embodiment of the support device.
Figure 31:
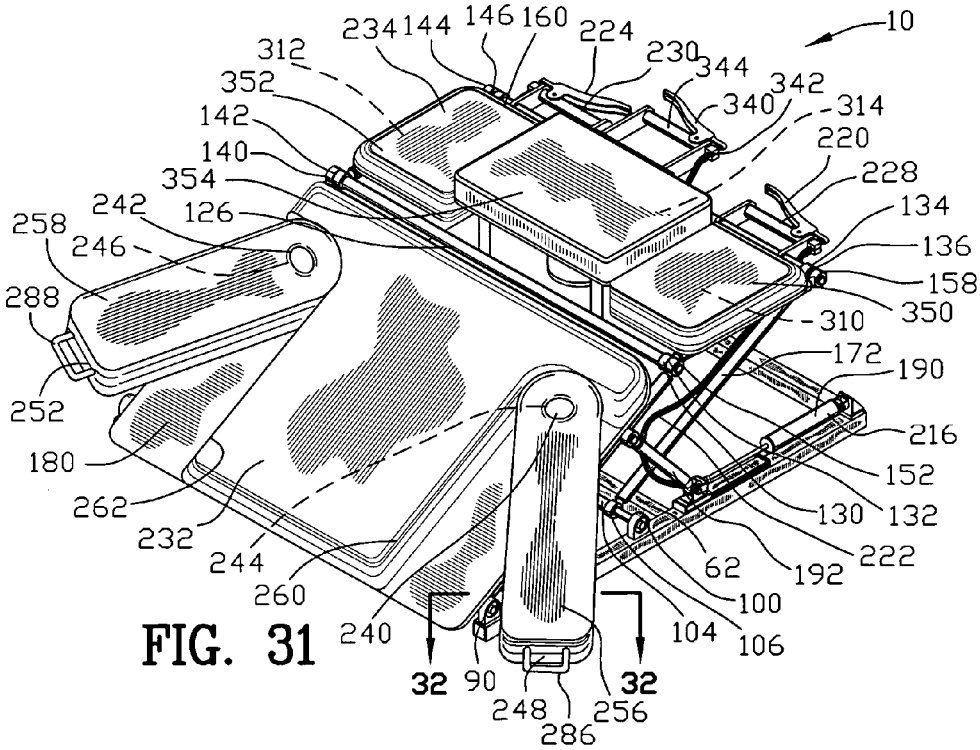
FIG. 31 is an isometric view similar to FIG. 30 illustrating the first arm plate and the second arm plate pivoting from the body plate and the center head plate in an elevated position.
Figure 32:
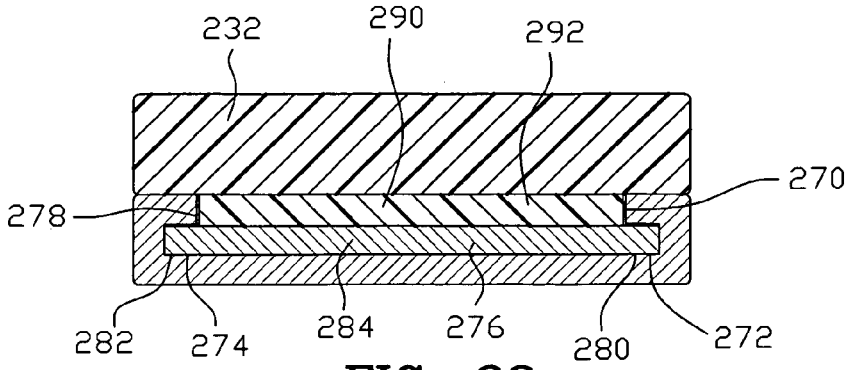
FIG. 32 is a sectional view along line 32-32 in FIG. 31.
Figure 33:
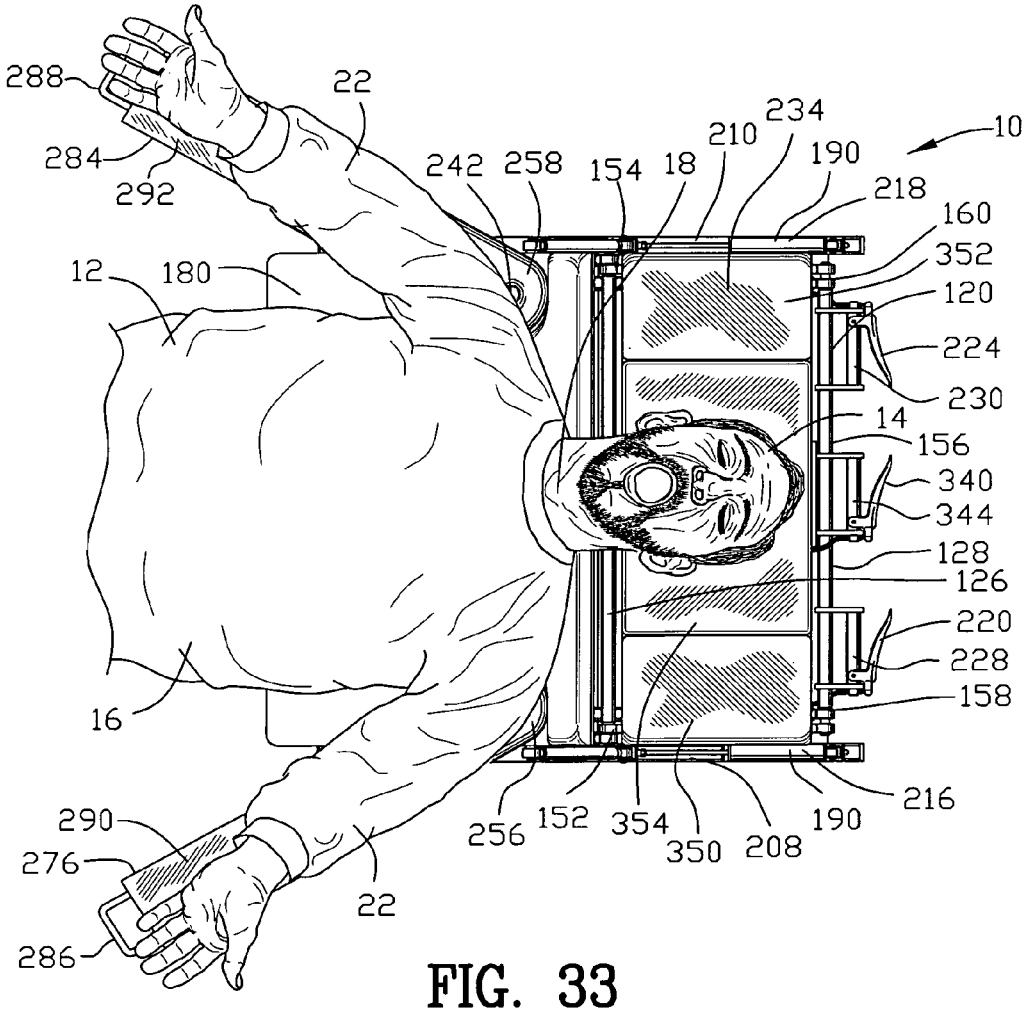
FIG. 33 is a top view similar to FIG. 17 illustrating an extendable first arm plate and an extendable second arm plate.
Figure 34:
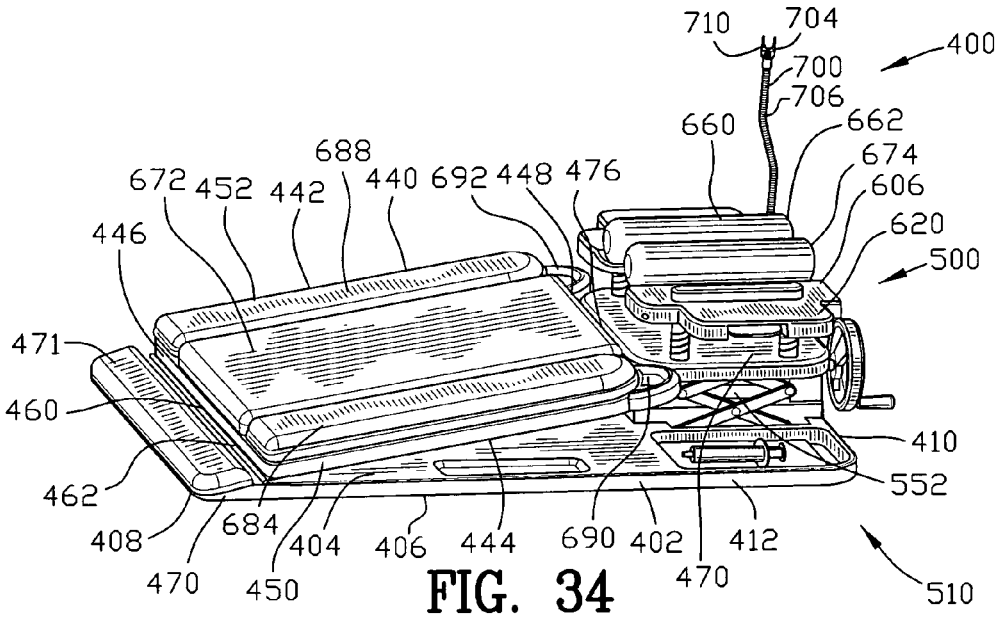
FIG. 34 is a side isometric view of a sixth embodiment for the support device in a non-elevated position.
Figure 35:
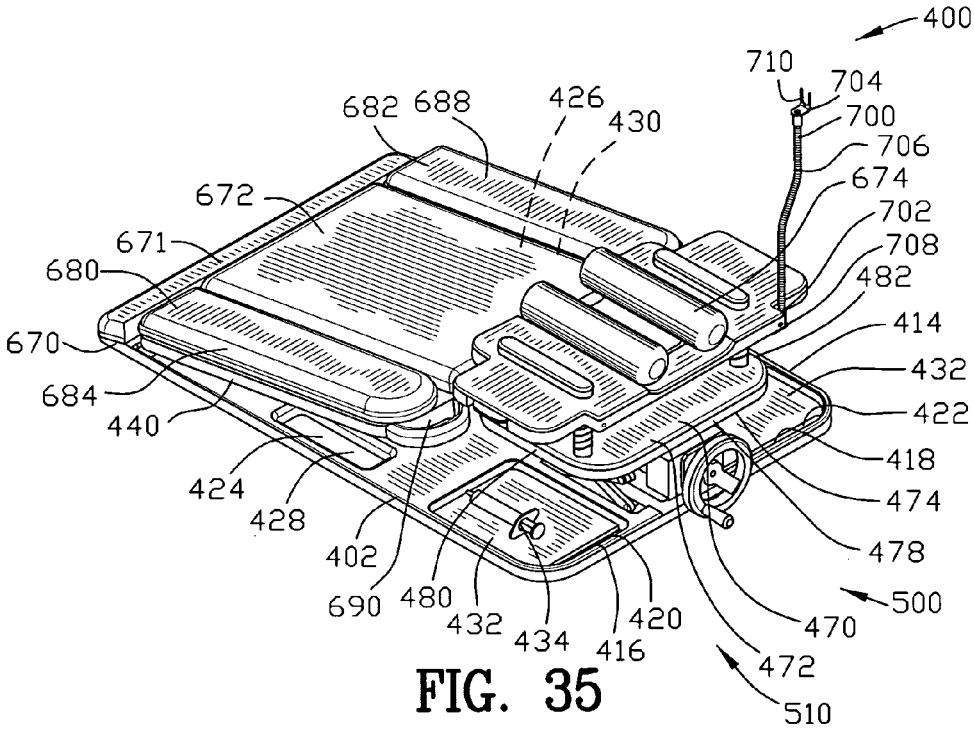
FIG. 35 is a rear isometric view of FIG. 34.
Figure 36:
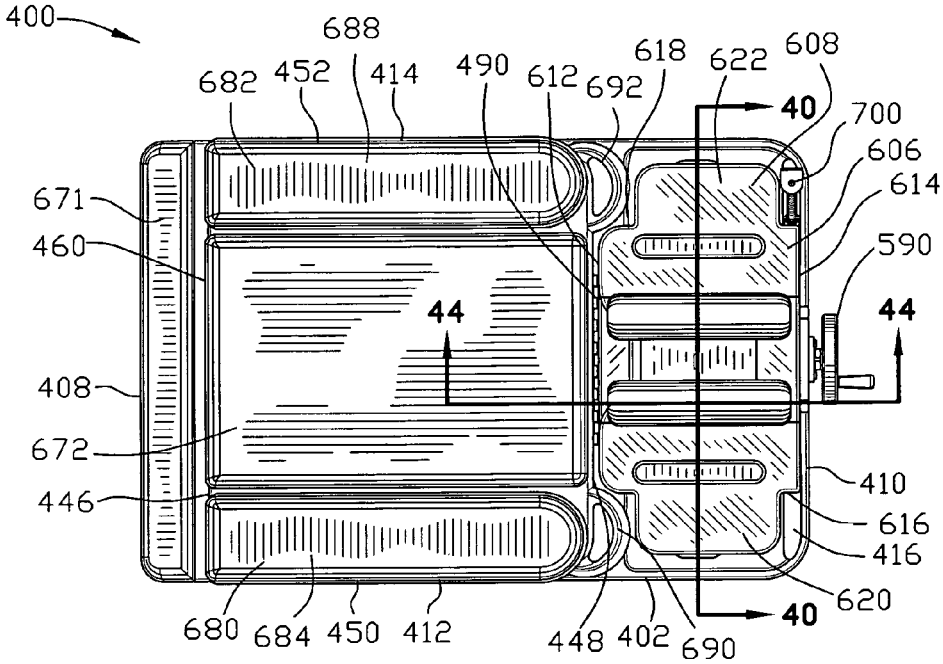
FIG. 36 is a top view of FIG. 34.
Figure 37:
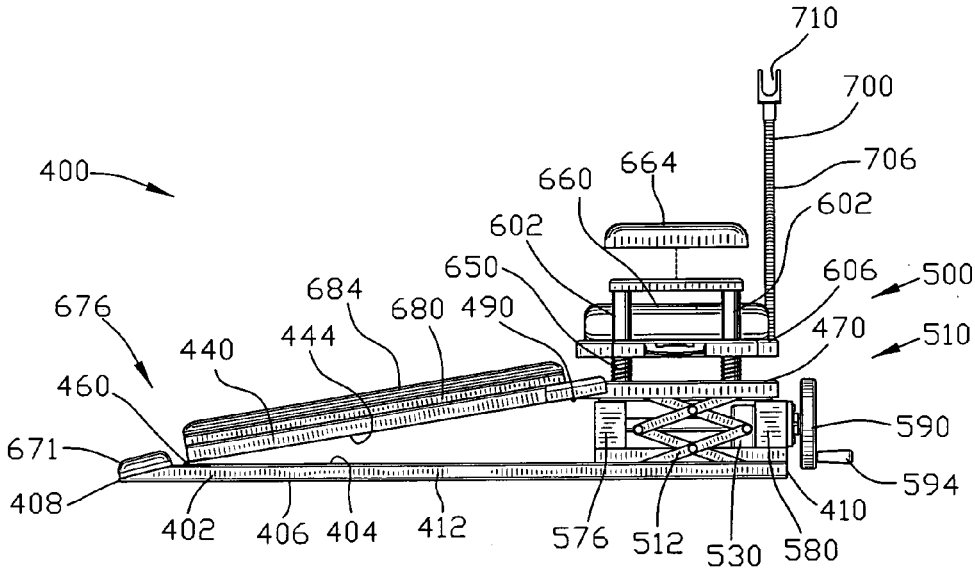
FIG. 37 is a side view of FIG. 36.
Figure 38:
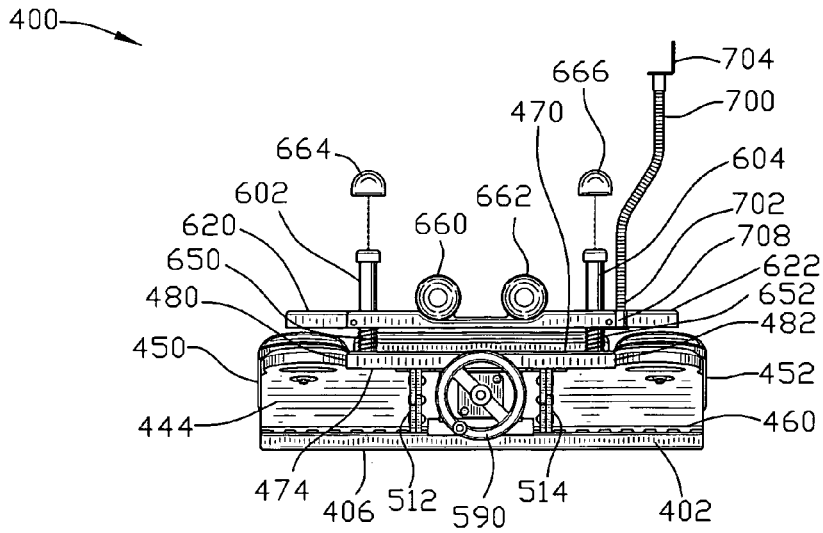
FIG. 38 is a rear view of FIG. 36.
Figure 39:
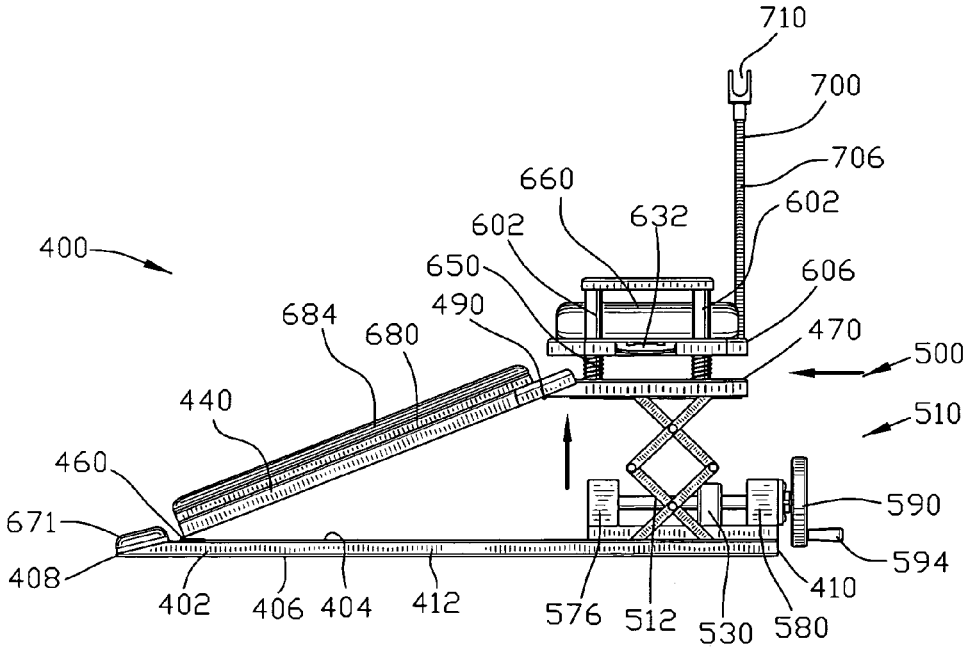
FIG. 39 is a side view similar to FIG. 37 illustrating the support device in an elevated position.
Figure 40:
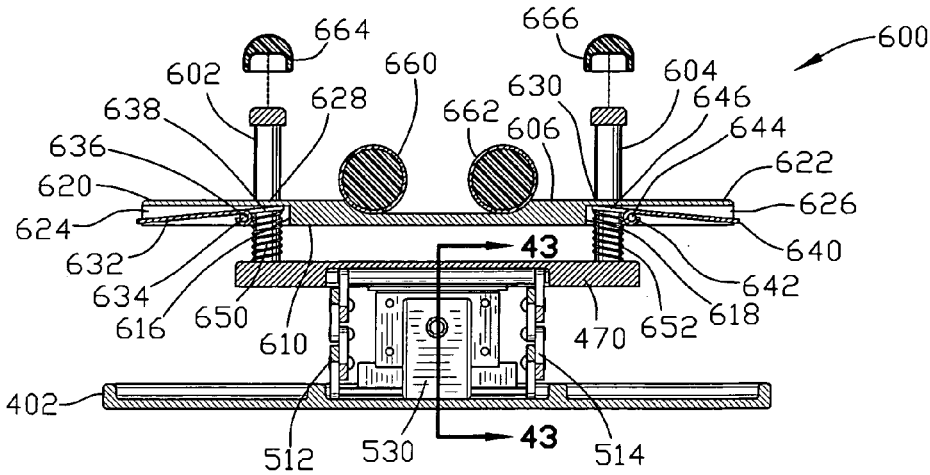
FIG. 40 is a sectional view along line 40-40 in FIG. 36.
Figure 41:
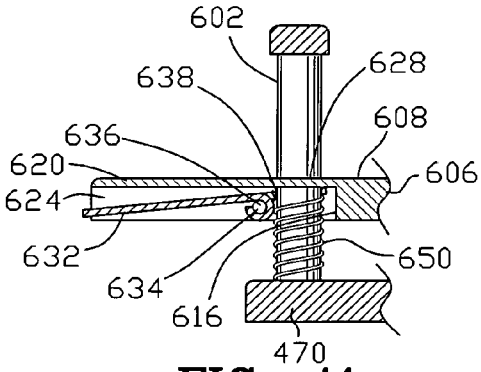
FIG. 41 is an enlarged view of a portion of FIG. 40 illustrating a second center head plate in an intermediate elevated position.
Figure 42:
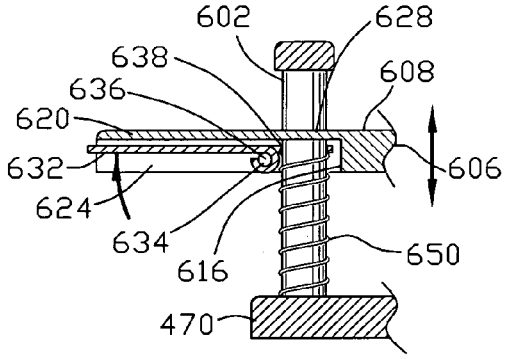
FIG. 42 is a view similar to FIG. 41 illustrating a first head support lock being disengaged to displace the second center head plate in an ascending position.

As best seen in FIG. 27, the center head plate 314 should be vertically displaced between 1 to 3 inches from the first head plate 310 and the second head plate 312. The vertical displacement of the head 14 from the head plate 182 adjusting the height of the head relative to the head plate for aligning the upper airway. By maintaining the body 16 positioned at 25° and the head 14 positioned horizontal, greater control of the upper airway 24 is achieved, endotracheal intubation is simplified and oxygenation of the individual 10 is improved.

FIGS. 9, 12 and 27 illustrate an oral axe 40, a pharyngeal axe 42 and a laryngeal axe 44. As seen in FIG. 9, the individual 12 is laying flat upon the support device 10. In FIG. 9, the oral axe 40, the pharyngeal axe 42 and the laryngeal axe 44 are far from alignment. As seen in FIG. 12, the body plate 180 and the head plate 182 of the support device 10 have elevated the head 14 of the individual 10 and positioned the body 16 of the individual 12 in an inclined position. In FIG. 12, the pharyngeal axe 42 and the laryngeal axe 44 are aligned; however, the oral axe 40 remains not aligned. As seen in FIG. 27, the body plate 180 and the center head plate 314 of the support device 10 have elevated the head 14 of the individual 12 and positioned the body 16 of the individual 10 in an inclined position. Furthermore, the center head plate 314 has extending the head 14 relative to the body 16 of the individual 12 for aligning the oral axe 40 with both the pharyngeal axe 42 and the laryngeal axe 44. The alignment of the oral axe 40, the pharyngeal axe 42 and the laryngeal axe 44 creates the shortest distance and the most straight line in the upper airway 24 or upper airway of the individual 12. The support device 10 aligns the oral axe 40, the pharyngeal axe 42 and the laryngeal axe 44 for providing many beneficial results. The alignment of the axes 40, 42 and 44 facilitate endotracheal intubation, decreases the work of the breathing of an obese individual, decreases transpulmonary shunting, hypoventilation and risk of hypoxia, decreases the degree of airway obstruction in those with obstructive sleep apnea, improves manual mask ventilation and laryngeal mask airways, increases the safe apnea period after induction of anesthesia and allows visualization of the upper airway 24.

FIGS. 34-51 illustrate a sixth embodiment of the subject invention. The support device 400 comprises a base plate 402 having a top surface 404, a bottom surface 406, a front edge 408, a rear edge 410, a first side edge 412 and a second side edge 414 for being positioned on a surface 5. The rear edge 410 of the base plate 402 including a first handle 416 and a second handle 418 for grasping the support device 400. The first handle 416 may include a first elongated aperture 420 traversing through the base plate 402. Similarly, the second handle 418 may include a second elongated aperture 422 traversing thought the base plate 402. The first side edge 412 and the second side edge 414 of the base plate 402 may have a third handle 424 and a fourth handle 426 respectively for grasping the support device 400. The third handle 424 may include a third elongated aperture 428 traversing through the base plate 402. Similarly, the fourth handle 426 may include a fourth elongated aperture 430 traversing thought the base plate 402. The top surface 404 of the base plate 402 may include a plurality of cavities 432 for receiving one or more tools 434. The base plate 402 may be constructed from a polymeric, metallic or other rigid materials.

The body plate 440 defines a top surface 442, a bottom surface 444, a front edge 446, a rear edge 448, a first side edge 450 and a second side edge 452 for supporting the body 16 of the individual 12. The body plate 440 may be constructed from a polymeric, metallic or other rigid materials.

A first pivot 460 pivotably secures the front edge 408 of the base plate 402 to the front edge 446 of the body plate 440 for changing the angle between the base plate 402 and the body plate 440. The first pivot 460 may include a piano hinge 462 or other pivoting devices. While the body 16 of the individual 12 rests upon the support device, an increase in the angle between the base plate 402 and the body plate 440 will inclining the body 16 relative to the surface 5. While the body 16 of the individual 12 rests upon the support device, an decrease in the angle between the base plate 402 and the body plate 440 will declining the body 16 relative to the surface 5.

A head plate 470 includes a top surface 472, a bottom surface 474, a front edge 476, a rear edge 478, a first side edge 480 and a second side edge 482 for supporting the head 14 of the individual 12. The head plate 470 may be constructed from a polymeric, metallic or other rigid materials.

A second pivot 490 pivotably secures the front edge 476 of the head plate 470 to the rear edge 448 of the body plate 440 for permitting the head plate 470 to pivot relative to the body plate 440. The second pivot 490 may include a piano hinge 492 or other pivoting devices.

A lift 500 extends between the top surface 404 of the base plate 402 and the bottom surface 474 of the head plate 470 for simultaneously adjusting the elevation of the head plate 470 and the inclination of the body plate 440 relative to the base plate 402. By adjusting the elevation of the head plate 470 and the inclination of the body plate 440 displaces the body 16 and the head 14 of the individual 12 for aligning the upper airway 24.

Figure 43:
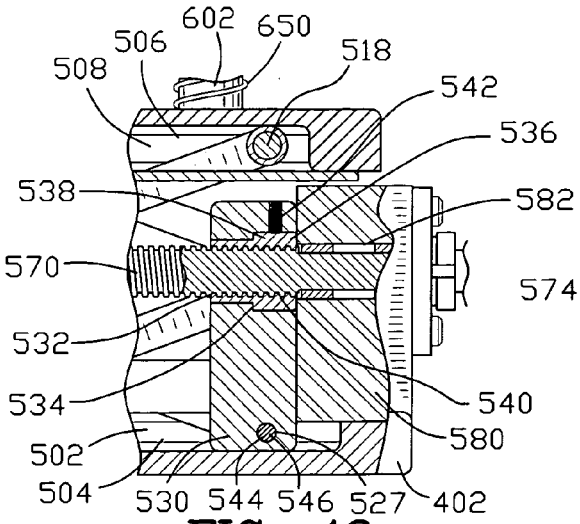
FIG. 43 is a sectional view along line 43-43 in FIG. 40.
Figure 44:
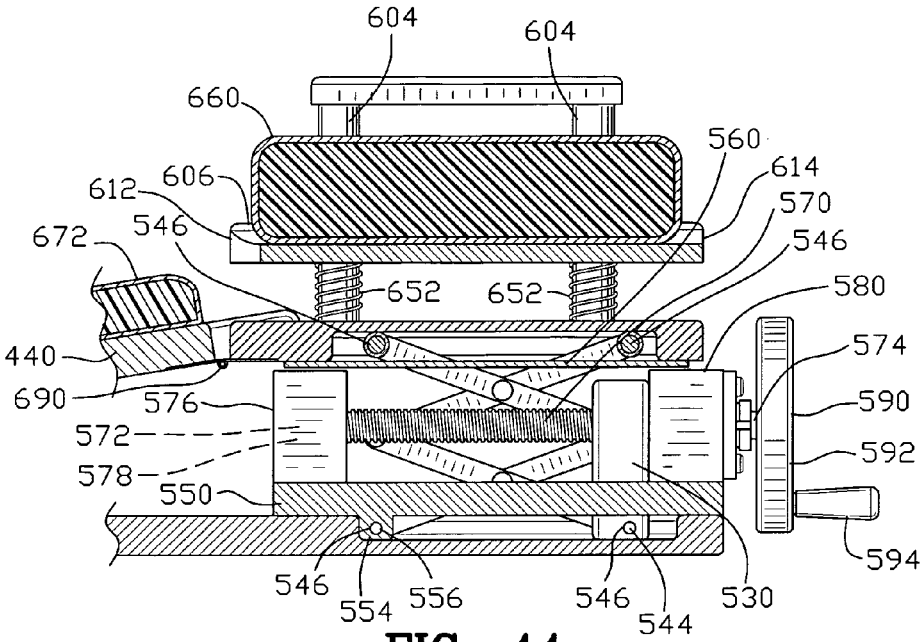
FIG. 44 is a sectional view along line 44-44 in FIG. 36.
Figure 45:
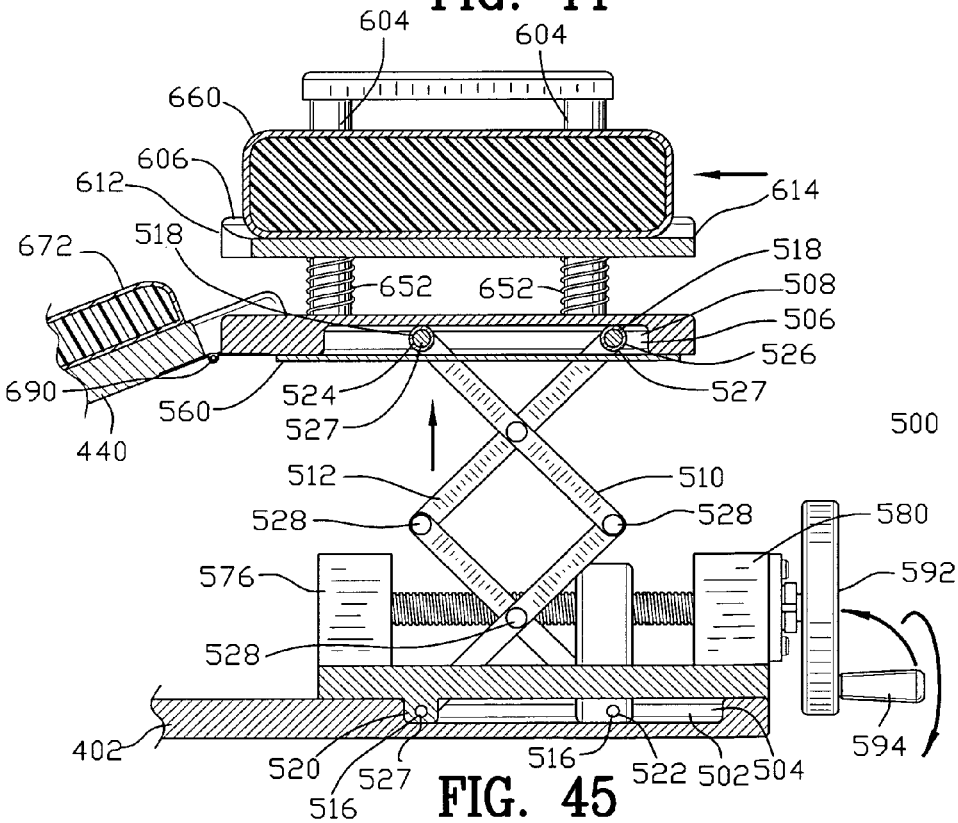
FIG. 45 is a side view similar to FIG. 44 illustrating the support device in an elevated position.

As best seen in FIGS. 43-45, the base plate 402 has a lower track 502 for permitting a horizontal displacement of the lift 500 during the adjusting of the elevation of the head plate 470 and the inclination of the body plate 440. Preferably, the lower track 502 is a lower channel 504 carved into the base plate 402. Similarly, the head plate 470 has an upper track 506 for permitting a horizontal displacement of the lift 500 during the adjusting of the elevation of the head plate 470 and the inclination of the body plate 440. Preferably, the upper track 506 is an upper channel 508 carved into the base plate 402.

The lift may include a scissor jack 510. The scissor jack 510 includes a first scissor frame 512 positioned adjacent to a second scissor frame 514. Each of the first and second scissor frames 510 and 512 extend between a lower jack end 516 and an upper jack end 518. Each of first and second scissor frames 510 and 512 include a front lower end 520 and a rear lower end 522 for positioning within the lower channel 504 of the base plate 402. Each of the first and second scissor frames 510 and 512 includes a front upper end 525 and a rear upper end 526 for positioning within the upper channel 508 of the head plate 470. The front lower ends 520 and rear lower ends 522 have a mounting bore 527 for securing the lift 500 to the support device 400. A plurality of scissor rods 528 couple the first scissor frame 510 to the second scissor frame 512.

A scissor block 530 slidably engages within the lower channel 504 of the base plate 402. The scissor block 530 includes a rod bore 532 having a bore step 534. A rod bushing 536 having an exterior step 538 and an interior threaded bore 540 is inserted to the rod bore 532. The exterior step 538 of the rod bushing 536 abuts the bore step 534 for terminating displacement of the rod bushing 536 in the direction of the front edge 408 of the base plate 402. A set screw 542 traverses the scissor block 530 and applies a compressive force against the rod bushing 536 for terminating displacement of the rod bushing 536 in the direction of the rear edge 410 of the base plate 402. The scissor block 530 may be constructed from a polymeric, metallic or other rigid materials.

The scissor block 530 further includes a lift bore 544 for aligning with the mounting bores 527 of rear lower ends 522. A mounting pin 546 traverses from the mounting bore 527 of the first scissor frame 512, through the lift bore 544 of the scissor block 530 and into the mounting bore 527 of the second scissor frame 514. The mounting pin 546 of the rear lower ends 522 of the lower jack end 516 pivotably secures the rear lower ends 522 of the lift 500 of the scissor block 530.

A lower locking plate 550 extends over the lower channel 504 and is secured to the top surface 404 of the base plate 402. The lower locking plate 550 may be secured by adhesive, fasteners or the securing means. The lower locking plate 550 is further positioned between the first scissor frame 512 and the second scissor frame 514. The mounting pin 546 of the rear lower ends 522 of the lower jack ends 516 are positioned beneath the lower locking plate 550 for securing the rear lower ends 522 of the lower jack end 516 within the lower channel 502. The lower locking plate 550 further includes a block channel 552 for channeling the scissor block 530 within the lower channel 502.

The lower locking plate 550 further includes a lower block 554 for positioning within the lower channel 502. The lower block 554 is positioned between first scissor frame 512 and the second scissor frame 514. The lower block 554 includes second lift bore 558 for aligning with the mounting bores 527 of front lower ends 520. A mounting pin 546 traverses from the mounting bore 527 of the first scissor frame 512, through the second lift bores 556 of the lower block 554 and into the mounting bore 527 of the second scissor frame 514. The mounting pin 546 of the front lower ends 520 of the lower jack end 516 pivotably secures the front lower ends 520 of the lift 500 of the scissor block 530. The mounting pin 546 of the front lower ends 520 of the lower jack end 516 is positioned beneath the lower locking plate 550 for securing the front lower ends 520 of the lower jack end 516 within the lower channel 502.

The rear upper end 526 and the front upper end 525 of the upper jack ends 518 slidably engage within the upper channel 508 of the head plate 470. An upper locking plate 560 extends over the upper channel 508 and is secured to the bottom surface 474 of the head plate 470. The upper locking plate 560 may be secured by adhesive, fasteners or the securing means. The upper locking plate 560 is further positioned between the first scissor frame 512 and the second scissor frame 514. The mounting pin 546 traverse from the mounting bore 527 of the front upper end 524 of the first scissor frame 512, above the upper locking plate 560 and into the mounting bore 527 of the front upper end 524 of the second scissor frame 514. Similarly, the mounting pin 546 traverse from the mounting bore 527 of the rear upper end 526 of the first scissor frame 512, above the upper locking plate 560 and into the mounting bore 527 of the rear upper end 526 of the second scissor frame 514. The mounting pins 546 of the front upper ends 524 and rear upper ends 526 of the upper jack ends 518 are positioned above the upper locking plate 560 for securing the rear upper ends 526 of the upper jack ends 518 within the upper channel 508.

A threaded rod 570 extends between a first end 572 and a second end 574. The threaded rod is positioned between the first scissor frame 512 and the second scissor frame 514. The threaded rod 570 threadably engages the interior threaded bore 540 of the rod bushing 536. A first rod mounting block 576 is positioned adjacent to the lift 500 and secured to the base plate 402. The first rod mounting block 576 includes a first rod bore 578 for rotatably engaging the first end 572 of the threaded rod 570. A second rod mounting block 580 is positioned adjacent to the rear edge 410 of the base plate 402 and secured to the base plate 402. The second rod mounting block 580 includes a second rod bore 582 for rotatably engaging the threaded rod 570. Preferably, the second end 574 of the threaded rod 570 traverses the second rod mounting block 580.

A scissor drive 590 that may include a wheel 592 is coupled to the second end 574 of the threaded rod 570 for applying a rotational force upon the threaded rod 570. The rotation of the threaded rod 570 displaces the scissor block 530 within the lower channel 504 for causing the scissor jack 510 to expand or contract. The expansion of the scissor jack 510 causes the head plate 470 and the inclination of the body plate 440 to ascend. The contraction of the scissor jack 510 causes the head plate 470 and the inclination of the body plate 440 to descend. The wheel 592 may further include a pivotable knob 594 for facilitating the rotation of the wheel 592.

As best seen in FIGS. 40-42 and 44-51, the head plate 470 further includes a head lift 600 for adjusting the elevation of the head 14 of the individual 12 independently of the body plate 440 and the head plate 470. The head lift 600 has a first vertical guide 602 and a second vertical guide 604 extending from the top surface 472 of the head plate 470. The head lift 600 further includes a head lift plate 606 having a top surface 608, a bottom surface 610, a front edge 612, a rear edge 614, a first side edge 616 and a second side edge 618. The head lift plate 606 may further include a first handling plate 620 and a second handling plate 622 extending from the first side edge 616 and the second side edge 618 respectively. The first handling plate 620 and the second handling plate 622 receive a vertical force by the operator. The bottom surface 610 of the first handling plate 620 and the second handling plate 622 include a first handle groove 624 and a second handle groove 626 respectively.

A first guide aperture 628 and a second guide aperture 630 traverse the head lift plate 606 for slidably engaging the first vertical guide 602 and a second vertical guide 604 respectively. A first lift lock 632 having a first cylindrical end 634 is pivotably secured within the first handle groove 624 of the first handling plate 620. A first lock pin 636 traverses thought the first cylindrical end 634 and into the head lift plate 606. The first lift lock 632 further includes a first lock aperture 638 for slidably engaging the first vertical guide 602. To permit displacement of the head lift plate 606 and the first lift lock 632 relative to the first vertical guide 602, a compressive force is applied between the first lift lock 632 and the head lift plate 606 causing the first lift lock 632 to be pivoted to a horizontal position for aligning the first lock aperture 638 with the first vertical guide 602.

A second lift lock 640 having a second cylindrical end 642 is pivotably secured within the second handle groove 626 of the second handling plate 622. A second lock pin 644 traverses thought the second cylindrical end 642 and into the head lift plate 606. The second lift lock 640 further includes a first lock aperture 646 for slidably engaging the second vertical guide 604. To permit displacement of the head lift plate 606 and the second lift lock 640 relative to the second vertical guide 604, a compressive force is applied between the second lift lock 640 and the head lift plate 606 causing the second lift lock 640 to be pivoted to a horizontal position for aligning the second lock aperture 646 with the second vertical guide 604.

A first helical spring 650 is positioned around the first vertical guide 602 and between the head plate 470 and the head lift plate 606 for creating an expansion force during an ascending displacement of the head lift plate 606 and creating resisting force during a descending displacement of the held lift plate 606. A second helical spring 652 is positioned around the second vertical guide 604 and between the head plate 470 and the head lift plate 606 for creating an expansion force during an ascending displacement of the head lift plate 606 and creating resisting force during a descending displacement of the held lift plate 606.

To terminate displacement of the head lift plate 606 and the first lift lock 632 relative to the first vertical guide 602, the compressive force between the first lift lock 632 and the head lift plate 606 is released causing the first lift lock 632 to be pivoted to a non-horizontal position. The non-horizontal position wedges the first lock aperture 638 with the first vertical guide 602 and terminates displacement between the head lift plate 606 relative to the first vertical guide 602. To assist the first lift lock 632 to be pivoted to a non-horizontal position the first helical spring 650 applies an expansion force against the first lift lock 632 along the first vertical guide 602. The wedging between the first lock aperture 638 and the first vertical guide 602 terminates displacement between the head lift plate relative to the first vertical guide.

To terminate displacement of the head lift plate 606 and the second lift lock 640 relative to the second vertical guide 604, the compressive force between the second lift lock 640 and the head lift plate 606 is released causing the second lift lock 640 to be pivoted to a non-horizontal position. The non-horizontal position wedges the second lock aperture 646 with the second vertical guide 604 and terminates displacement between the head lift plate 606 relative to the second vertical guide 604. To assist the second lift lock 640 to be pivoted to a non-horizontal position the second helical spring 652 applies an expansion force against the second lift lock 640 along the second vertical guide 604. The wedging between the second lock aperture 646 and the second vertical guide 604 terminates displacement between the head lift plate relative to the second vertical guide 604.

A first cylindrical cushion 660 and a second cylindrical cushion 662 may be secured to the top surface 608 of the head lift plate 606 for preventing rotation of the head 14 of the individual 12. Furthermore, a first cushion cap 664 and a second cushion cap 66 cover the first vertical guide 602 and the second vertical guide 604 respectively for protecting the head 14 of the individual 12.

As best seen in FIGS. 34-37 and 46-51, the front edge 408 of the base plate 402 may include a tapered body 670 for defining a generally linear plain 676 between the bottom surface 406 of the base plate 402 and the top surface 472 of the body plate 440. The tapered body 670 prevents the body 16 of the individual 12 from being pinched between the body plate 440 and the base plate 402.

To improve the confront of the individual 12 positioned on the support device 400, a body plate cushion 672 is secured to the top surface 442 of the body plate 440 for padding the body 16 of the individual 12. A head plate cushion 674 is secured to the top surface 472 of the head plate 470 for padding the head 14 of the individual 12. A taper body cushion is secured to the taper body 670 for padding the body 16 of the individual 12.

As best seen in FIGS. 34-36, 48 and 49, the body plate 440 may include a first arm plate 680 pivotably secured to the body plate 440 for supporting the first arm 20 of the individual 12 in a position that is not adjacent to the body 16. Similarly, a second arm plate 682 is pivotably secured to the body plate 440 for supporting the second arm 22 of the individual 12 in a position that is not adjacent to the body 16. A first arm cushion 684 is secured to the first arm plate 680 for padding the first arm 20 of the individual 12. A second arm cushion 688 is secured to the second arm plate 682 for padding the second arm 22 of the individual 12. As seen in FIGS. 34-36, 48 and 49, the rear edge 448 of the body plate 440 may include a fifth handle 690 and a sixth handle 692 for grasping the support device 400.

As seen in FIGS. 34-39, a breathing circuit holder 700 extends between a mounting end 702 and a breathing circuit receiver end 704. A flexible rod 706 couples the mounting end 702 and the breathing circuit end 704. A coupler 708 secures the mounting end 702 with either the head plate 470 or the head lift plate 606. A generally U-shaped receiver 710 secured to the breathing circuit end 704 couples a breathing circuit with the breathing circuit holder 700. The flexible rod 706 permits the generally U-shaped receiver 710 to be positioned at multiple locations relative to the either the head plate 470 or the head lift plate 606.

Figure 46:
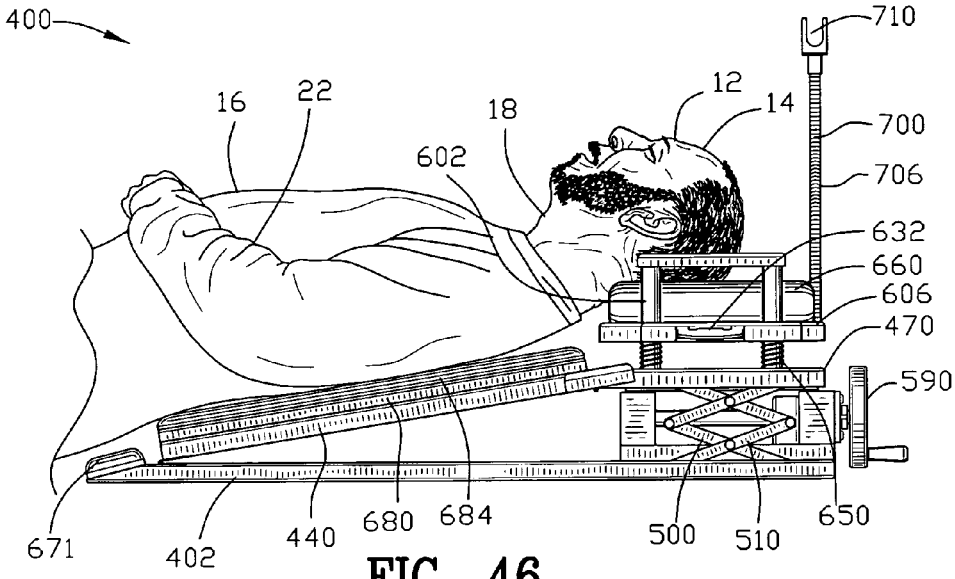
FIG. 46 is a view similar to FIG. 37 illustrating an individual positioned on the support device.
Figure 47:
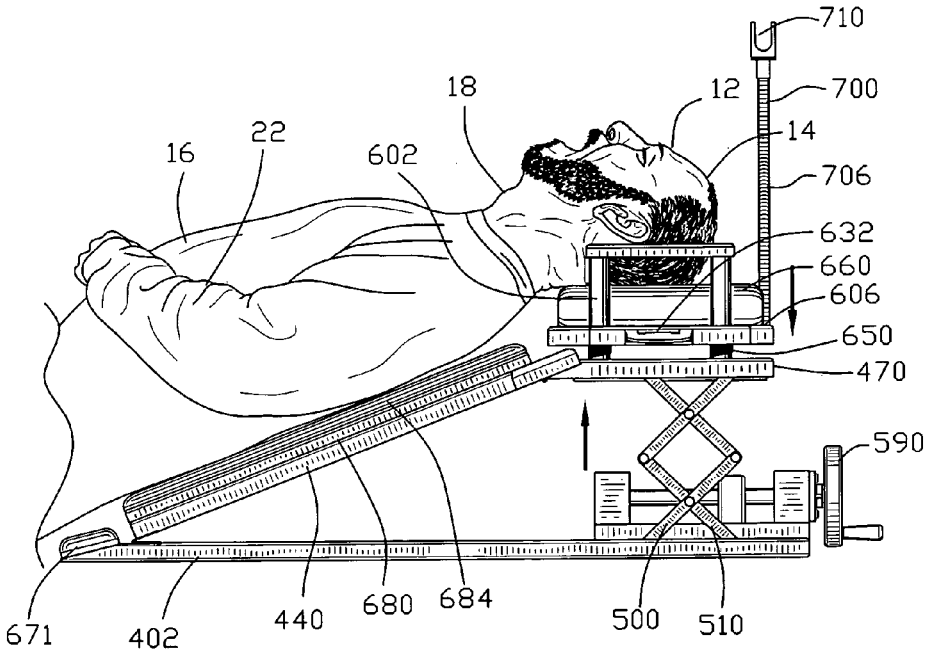
FIG. 47 is a view similar to FIG. 46 illustrating the support device in an elevated position.
Figure 48:
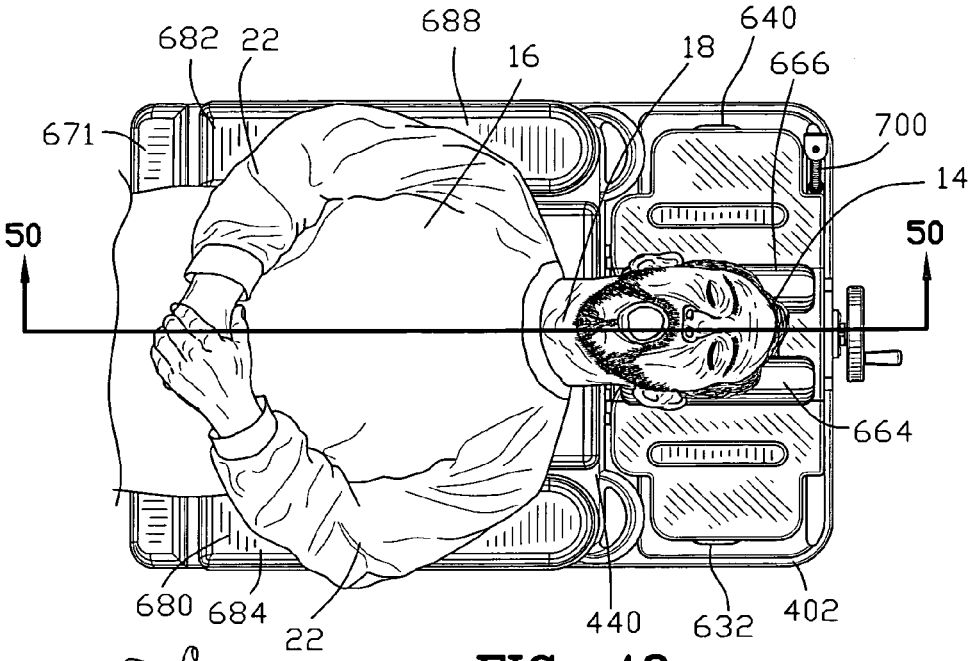
FIG. 48 is a top view of FIG. 47.
Figure 49:
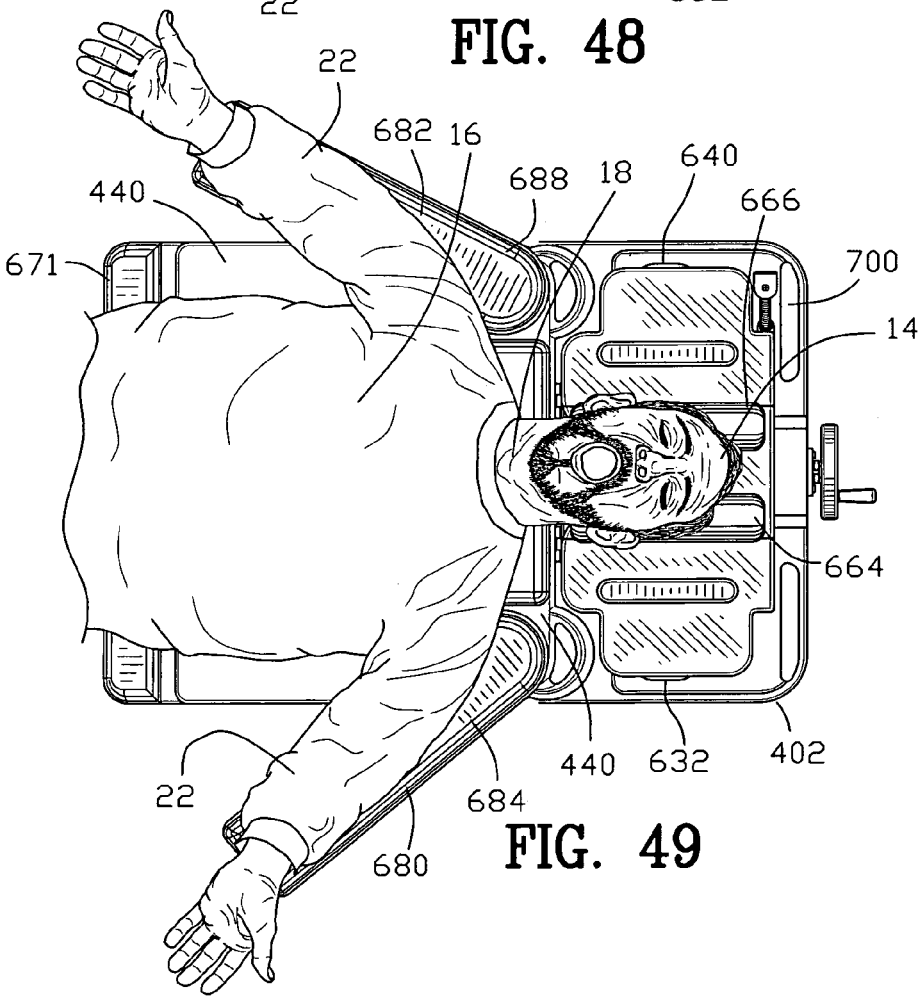
FIG. 49 is a view similar to FIG. 48 illustrating a first arm plate and a second arm plate pivoting from the body plate.
Figure 50:
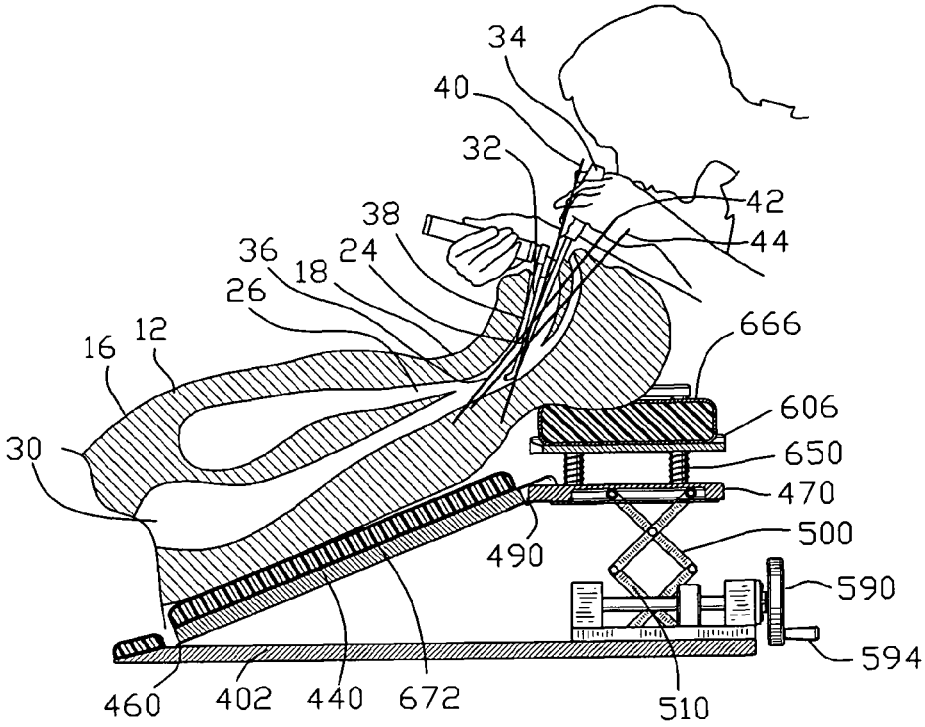
FIG. 50 is a sectional view along line 50-50 in FIG. 48 illustrating an upper airway aligned and the insertion of endotracheal tube.
Figure 51:
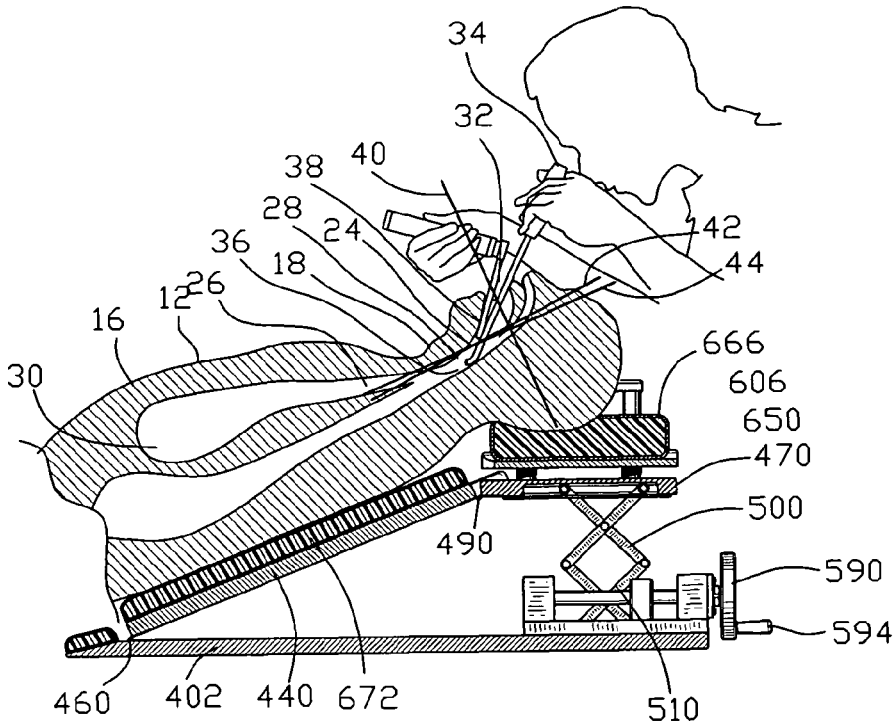
FIG. 51 is a view similar to FIG. 50 illustrating an upper airway aligned and the insertion of endotracheal tube.

FIGS. 50 and 51 illustrate an oral axe 40, a pharyngeal axe 42 and a laryngeal axe 44. As seen in FIG. 46, the individual 12 is laying flat upon the support device 400. In FIG. 46, the oral axe 40, the pharyngeal axe 42 and the laryngeal axe 44 are far from alignment. As seen in FIG. 51, the body plate 440 and the head plate 470 of the support device 400 have elevated the head 14 of the individual 10 and positioned the body 16 of the individual 12 in an inclined position. In FIG. 51, the pharyngeal axe 42 and the laryngeal axe 44 are aligned; however, the oral axe 40 remains not aligned. As seen in FIG. 50, the body plate 440 and the head lift plate 606 of the support device 400 have elevated the head 14 of the individual 12 and positioned the body 16 of the individual 10 in an inclined position. Furthermore, the head lift plate 606 has extending the head 14 relative to the body 16 of the individual 12 for aligning the oral axe 40 with both the pharyngeal axe 42 and the laryngeal axe 44. The alignment of the oral axe 40, the pharyngeal axe 42 and the laryngeal axe 44 creates the shortest distance and the most straight line in the upper airway 24 or upper airway of the individual 12. The support device 400 aligns the oral axe 40, the pharyngeal axe 42 and the laryngeal axe 44 for providing many beneficial results. The alignment of the axes 40, 42 and 44 facilitate endotracheal intubation, decreases the work of the breathing of an obese individual, decreases transpulmonary shunting, hypoventilation and risk of hypoxia, decreases the degree of airway obstruction in those with obstructive sleep apnea, improves manual mask ventilation and laryngeal mask airways, increases the safe apnea period after induction of anesthesia and allows visualization of the upper airway 24.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A support device for positioning an individual in an inclined orientation, the individual having a head secured to a body by a neck, a first arm and a second arm extending from the body, the head having an upper airway and the body having a lower airway for delivering oxygen into the individual, the support device, comprising:

a lower rectangular frame defining a first lower side, a second lower side, a front lower side and a rear lower side;

a first lower pivot secured to said first lower side of said lower rectangular frame at a first position;

a second lower pivot secured to said first lower side of said lower rectangular frame at a second position;

said first position and said second position defining a first length between said first position and said second position;

a third lower pivot secured to said second lower side of said lower rectangular frame at a third position;

a fourth lower pivot secured to said second lower side of said lower rectangular frame at a fourth position;

said third position and said fourth position defining a second length between said third position and said fourth position;

said first length and said second length having an equivalent dimension;

said first position and said third position having a parallel alignment with said second position and said fourth position;

an upper rectangular frame defining a first upper side, a second upper side, a front upper side and a rear upper side;

a first upper pivot secured to said first upper side of said upper rectangular frame at a fifth position;

a second upper pivot secured to said first upper side of said upper rectangular frame at a sixth position;

said fifth position and said sixth position defining a third length between said fifth position and said sixth position;

a third upper pivot secured to said second upper side of said upper rectangular frame at a seventh position;

a fourth upper pivot secured to said second upper side of said upper rectangular frame at an eighth position;

said seventh position and said eighth position defining a fourth length between said seventh position and said eighth position;

said third length and said fourth length having an equivalent dimension;

said fifth position and said seventh position having a parallel alignment with said sixth position and said eighth position;

a first frame linkage extending between said first lower pivot of said lower rectangular frame to said first upper pivot of said upper rectangular frame for pivoting said upper rectangular frame relative to said lower rectangular frame;

a second frame linkage extending between said second lower pivot of said lower rectangular frame to said second upper pivot of said upper rectangular frame for pivoting said upper rectangular frame relative to said lower rectangular frame;

a third frame linkage extending between said third lower pivot of said lower rectangular frame to said third upper pivot of said upper rectangular frame for pivoting said upper rectangular frame relative to said lower rectangular frame;

a fourth frame linkage extending between said fourth lower pivot of said lower rectangular frame to said fourth upper pivot of said upper rectangular frame for pivoting said upper rectangular frame relative to said lower rectangular frame;

said first length, said second length, said third length, said fourth length, said first frame linkage, said second frame linkage, said third frame linkage and said fourth frame linkage defining a parallelogram frame for pivoting said upper rectangular frame relative to said lower rectangular frame while retaining said upper rectangular frame parallel to said lower rectangular frame;

a body plate positioning between said first frame linkage and said third frame linkage for supporting the body of the individual;

a head plate positioning within said upper rectangular frame for supporting the head of the individual;

a drive engaging between said lower rectangular frame and said parallelogram frame for displacing said body plate and said head plate for adjusting the height of the body and the head of the individual relative to said lower rectangular frame; and said adjusting of the height of the body and the head of the individual relative to said lower rectangular frame aligning the upper airway.

2. A support device for positioning an individual in an inclined orientation as set forth in claim 1, wherein said second lower pivot is inset to said first lower pivot for defining a first channel;

said first channel permitting said first frame linkage to be positioned adjacent to said second frame linkage for collapsing said parallelogram frame adjacent to said lower rectangular frame;

said fourth lower pivot is inset to said third lower pivot for defining a second channel; and said second channel permitting said third frame linkage to be positioned adjacent to said fourth frame linkage for collapsing said parallelogram frame adjacent to said lower rectangular frame.

3. A support device for positioning an individual in an inclined orientation as set forth in claim 1, wherein a drive linkage extends between a frame end and a drive end;

a frame pivot is secured to said parallelogram frame for pivotably coupling said frame end of said drive linkage to said parallelogram frame; and said drive engaging between said drive end of said drive linkage and lower rectangular frame.

4. A support device for positioning an individual in an inclined orientation as set forth in claim 1, wherein a drive linkage includes a first drive linkage and a second drive linkage;

said first drive linkage extending from said first frame linkage to said first lower side of said lower rectangular frame;

said second drive linkage extending from said third frame linkage to said second lower side of said lower rectangular frame;

a first frame pivot is secured to said first frame linkage for pivotably coupling said frame end of said first drive linkage to said parallelogram frame;

a second frame pivot is secured to said second frame linkage for pivotably coupling said frame end of said second drive linkage to said parallelogram frame;

a first drive engaging between said first drive linkage and said first lower side of said lower rectangular frame for pivoting said parallelogram frame; and a second drive engaging between said second drive linkage and said second lower side of said lower rectangular frame for pivoting said parallelogram frame.

5. A support device for positioning an individual in an inclined orientation as set forth in claim 1, wherein said drive includes a track positioned along said first lower side of said lower rectangular frame;

a car pivotably engages said drive end of said drive linkage and slidably engages said track; and a pneumatic cylinder secured between said first lower side of said lower rectangular frame and said car for pivoting said parallelogram frame.

6. A support device for positioning an individual in an inclined orientation as set forth in claim 1, wherein a drive linkage includes a first drive linkage and a second drive linkage;

said first drive linkage extending from said first frame linkage to said first lower side of said lower rectangular frame;

said second drive linkage extending from said third frame linkage to said second lower side of said lower rectangular frame;

said drive includes a first track and a second track;

said first track positioned along said first lower side of said lower rectangular frame;

said second track positioned along said second lower side of said lower rectangular frame;

a first car pivotably engages said drive end of said first drive linkage and slidably engages said first track;

a second car pivotably engages said drive end of said second drive linkage and slidably engages said second track;

a first pneumatic cylinder secured between said first lower side of said lower rectangular frame and said first car;

a second pneumatic cylinder secured between said second lower side of said lower rectangular frame and said second car; and said first pneumatic cylinder and said second pneumatic cylinder pivoting said parallelogram frame.

7. A support device for positioning an individual in an inclined orientation as set forth in claim 1, wherein said rear upper side of said upper rectangular frame includes a drive actuator for activating said drive and applying a vertical force to said parallelogram frame.

8. A support device for positioning an individual in an inclined orientation as set forth in claim 1, wherein said body plate includes a body cushion layer for padding the body of the individual.

9. A support device for positioning an individual in an inclined orientation as set forth in claim 1, wherein said head plate includes a head cushion layer for padding the head of the individual.

10. A support device for positioning an individual in an inclined orientation as set forth in claim 1, wherein said body plate includes a first arm plate pivotably secured to said body plate for supporting the first arm of the individual; and a second arm plate pivotably secured to said body plate for supporting the second arm of the individual.

11. A support device for positioning an individual in an inclined orientation as set forth in claim 1, wherein said body plate includes a first pivot pin and a second pivot pin;

a first polymeric disk and a second polymeric disk positioned about said first pivot pin and said second pivot pin respectively;

a first arm plate pivotably secured to said first pivot pin of said body plate for supporting the first arm of the individual;

a second arm plate pivotably secured to said second pivot pin of said body plate for supporting the second arm of the individual;

a first fastener engaging said first pivot pin for compressing said first polymeric disk between said body plate and said first arm plate for resisting pivoting of said first arm plate relative to said body plate; and a second fastener engaging said second pivot pin for compressing said second polymeric disk between said body plate and said second arm plate for resisting pivoting of said second arm plate relative to said body plate.

12. A support device for positioning an individual in an inclined orientation as set forth in claim 1, wherein said body plate includes a first arm plate pivotably secured to said body plate for supporting the first arm of the individual;

a second arm plate pivotably secured to said body plate for supporting the second arm of the individual;

a first arm cushion secured to said first arm plate for padding the first arm of the individual;

a second arm plate pivotably secured to said body plate for supporting the second arm of the individual;

a second arm cushion secured to said second arm plate for padding the second arm of the individual.

13. A support device for positioning an individual in an inclined orientation as set forth in claim 1, wherein said body plate includes a first arm plate pivotably secured to said body plate for supporting the first arm of the individual;

said first arm plate including a first cavity defining a first groove and a second groove;

an extendable first arm plate slidably engaging between said first groove and said second groove for extending the length of said first arm plate;

a second arm plate pivotably secured to said body plate for supporting the second arm of the individual;

said second arm plate including a second cavity defining a third groove and a fourth groove;

an extendable second arm plate slidably engaging between said third groove and said fourth groove for extending the length of said second arm plate.

14. A support device for positioning an individual in an inclined orientation as set forth in claim 1, wherein said body plate includes a first arm plate pivotably secured to said body plate for supporting the first arm of the individual;

said first arm plate including a first cavity defining a first groove and a second groove;

an extendable first arm plate slidably engaging between said first groove and said second groove for extending the length of said first arm plate;

a third arm cushion secured to said extendable first arm plate and engaging within said first cavity for padding the first arm of the individual;

a second arm plate pivotably secured to said body plate for supporting the second arm of the individual;

said second arm plate including a second cavity defining a third and fourth groove;

an extendable second arm plate slidably engaging between said third groove and fourth groove for extending the length of said second arm plate;

a fourth arm cushion secured to said extendable second arm plate and engaging within said second cavity for padding the second arm of the individual.

15. A support device for positioning an individual in an inclined orientation as set forth in claim 1, wherein said upper rectangular frame includes a cradle frame extending below said upper rectangular frame;

said cradle frame defining a front vertical member, a rear vertical member and a horizontal member extending between said front vertical member and said rear vertical member;

said head plate includes a first head plate, a second head plate and a center head plate positioned between said first head plate and said second head plate;

a head drive engaging said horizontal member of said cradle frame and said center head plate for vertically displacing said center head plate for adjusting the height of the head of the individual relative to the head plate; and adjusting the height of the head relative to the head plate aligning the upper airway.

16. A support device for positioning an individual in an inclined orientation as set forth in claim 1, wherein said upper rectangular frame includes a cradle frame extending below said upper rectangular frame;

said cradle frame defining a front vertical member, a rear vertical member and a horizontal member extending between said front vertical member and said rear vertical member;

said head plate includes a first head plate, a second head plate and a center head plate positioned between said first head plate and said second head plate;

a first vertical cylinder and a second vertical cylinder extending from said horizontal member of said cradle frame;

a first vertical rod and a second vertical rod extending from said center head plate;

said first vertical rod and said second vertical rod slidably engaging into said first vertical cylinder and said second vertical cylinder respectively; and a head drive engaging said horizontal member of said cradle frame and said center head plate for vertically displacing said center head plate for adjusting the height of the head of the individual relative to the head plate.

17. A support device for positioning an individual in an inclined orientation as set forth in claim 1, wherein said upper rectangular frame includes a cradle frame extending below said upper rectangular frame;

said cradle frame defining a front vertical member, a rear vertical member and a horizontal member extending between said front vertical member and said rear vertical member;

said head plate includes a first head plate, a second head plate and a center head plate positioned between said first head plate and said second head plate;

a head drive engaging said horizontal member of said cradle frame and said center head plate for vertically displacing said center head plate for adjusting the height of the head of the individual relative to the head plate; and said center head plate includes a head drive actuator for activating said head drive and applying a vertical force to said center head plate.

18. A support device for positioning an individual in an inclined orientation as set forth in claim 1, wherein said upper rectangular frame includes a cradle frame extending below said upper rectangular frame;

said cradle frame defining a front vertical member, a rear vertical member and a horizontal member extending between said front vertical member and said rear vertical member;

said head plate includes a first head plate, a second head plate and a center head plate positioned between said first head plate and said second head plate;

a head drive engaging said horizontal member of said cradle frame and said center head plate for vertically displacing said center head plate for adjusting the height of the head of the individual relative to the head plate; and said head drive including a head pneumatic cylinder.

19. A support device for positioning an individual in an inclined orientation as set forth in claim 1, wherein said head plate includes a first head plate, a second head plate and a center head plate positioned between said first head plate and said second head plate;

a first head cushion layer, a second head cushion layer and a center head cushion layer secured to said first head plate, said second head plate and said center head plate respectively for padding the head of the individual.

20. A support device for positioning an individual in an inclined orientation, the individual having a head secured to a body by a neck, the support device, comprising:

a lower rectangular frame defining a first lower side, a second lower side, a front lower side and a rear lower side;

a first lower pivot secured to said first lower side of said lower rectangular frame at a first position;

a second lower pivot secured to said first lower side of said lower rectangular frame at a second position;

said first position and said second position defining a first length between said first position and said second position;

a third lower pivot secured to said second lower side of said lower rectangular frame at a third position;

a fourth lower pivot secured to said second lower side of said lower rectangular frame at a fourth position;

said third position and said fourth position defining a second length between said third position and said fourth position;

said first length and said second length having an equivalent dimension;

said first position and said third position having a parallel alignment with said second position and said fourth position;

an upper rectangular frame defining a first upper side, a second upper side, a front upper side and a rear upper side;

a first upper pivot secured to said first upper side of said upper rectangular frame at a fifth position;

a second upper pivot secured to said first upper side of said upper rectangular frame at a sixth position;

said fifth position and said sixth position defining a third length between said fifth position and said sixth position;

a third upper pivot secured to said second upper side of said upper rectangular frame at a seventh position;

a fourth upper pivot secured to said second upper side of said upper rectangular frame at an eighth position;

said seventh position and said eighth position defining a fourth length between said seventh position and said eighth position;

said third length and said fourth length having an equivalent dimension;

said fifth position and said seventh position having a parallel alignment with said sixth position and said eighth position;

a first frame linkage extending between said first lower pivot of said lower rectangular frame to said first upper pivot of said upper rectangular frame for pivoting said upper rectangular frame relative to said lower rectangular frame;

a second frame linkage extending between said second lower pivot of said lower rectangular frame to said second upper pivot of said upper rectangular frame for pivoting said upper rectangular frame relative to said lower rectangular frame;

a third frame linkage extending between said third lower pivot of said lower rectangular frame to said third upper pivot of said upper rectangular frame for pivoting said upper rectangular frame relative to said lower rectangular frame;

a fourth frame linkage extending between said fourth lower pivot of said lower rectangular frame to said fourth upper pivot of said upper rectangular frame for pivoting said upper rectangular frame relative to said lower rectangular frame;

said first length, said second length, said third length, said fourth length, said first frame linkage, said second frame linkage, said third frame linkage and said fourth frame linkage defining a parallelogram frame for pivoting said upper rectangular frame relative to said lower rectangular frame while retaining said upper rectangular frame parallel to said lower rectangular frame;

a body plate positioning between said first frame linkage and said third frame linkage for supporting the body of the individual;

a head plate positioning within said upper rectangular frame for supporting the head of the individual; and a drive engaging between said lower rectangular frame and said parallelogram frame for displacing said body plate and said head plate for adjusting the height of the body and the head of the individual relative to said lower rectangular frame.

21. A support device for positioning an individual in an inclined orientation, the individual having a neck coupling a head with a body, a first arm and a second arm extending from the body, the head having an upper airway and the body having a lower airway for delivering oxygen into the individual, the support device, comprising:

a base plate defining a top surface, a bottom surface, a front edge, a rear edge, a first side edge and a second side edge;

a body plate defining a top surface, a bottom surface, a front edge, a rear edge, a first side edge and a second side edge for supporting the body of the individual;

a first pivot pivotably securing said front edge of said base plate to said front edge of said body plate for inclining said body plate relative to said base plate;

a head plate defining a top surface, a bottom surface, a front edge, a rear edge, a first side edge and a second side edge for supporting the head of the individual;

a second pivot pivotably securing said front edge of said head plate to said rear edge of said body plate for permitting said head plate to pivot relative to said body plate;

a lift extending between said top surface of said base plate and said bottom surface of said head plate for simultaneously adjusting the elevation of said head plate and the inclination of said body plate relative to said base plate; and said adjusting of the elevation of said head plate and the inclination of said body plate displacing the body and the head of the individual for aligning the upper airway.

22. A support device for positioning an individual in an inclined orientation as set forth in claim 21, wherein said base plate having a lower track for permitting a horizontal displacement of said lift during said adjusting of the elevation of said head plate and the inclination of said body plate; and said head plate having a upper track for permitting a horizontal displacement of said lift during said adjusting of the elevation of said head plate and the inclination of said body plate.

23. A support device for positioning an individual in an inclined orientation as set forth in claim 21, wherein said top surface of said base plate having a lower channel;

said bottom surface of said head plate having an upper channel;

said lift includes a scissor jack extending between a lower jack end and an upper jack end;

said lower jack end having a front lower end and a rear lower end for positioning within said lower channel of said base plate;

said upper jack end having a front upper end and a rear upper end for positioning within said upper channel of said head plate;

a scissor block slidably engaging within said lower channel of said base plate;

said scissor block having a threaded aperture;

said rear lower end of said lower jack end pivotably secured to said scissor block;

said front lower end of said lower jack end pivotably secured within said lower channel of said base plate;

said rear upper end and said front upper end of said upper jack end slidably engaging with said upper channel of said head plate;

a threaded rod traversing said threaded aperture of said scissor block; and a scissor drive for rotating said threaded rod to displace said scissor block within said lower channel for adjusting of the elevation of said head plate and the inclination of said body plate.

24. A support device for positioning an individual in an inclined orientation as set forth in claim 21, wherein said top surface of said base plate having a lower channel;

said bottom surface of said head plate having an upper channel;

said lift includes a scissor jack extending between a lower jack end and an upper jack end;

said lower jack end having a front lower end and a rear lower end for positioning within said lower channel of said base plate;

said upper jack end having a front upper end and a rear upper end for positioning within said upper channel of said head plate;

a scissor block slidably engaging within said lower channel of said base plate;

said scissor block having a threaded aperture;

said rear lower end of said lower jack end pivotably secured to said scissor block;

said front lower end of said lower jack end pivotably secured within said lower channel of said base plate;

said rear upper end and said front upper end of said upper jack end slidably engaging with said upper channel of said head plate;

a mounting pin traversing each of said front lower end and said rear lower end of said lower jack end and said front upper end and said rear upper end of said upper jack end;

a lower locking plate engaging over said lower channel of said base plate for locking said front lower end and said rear lower end of said lower jack end within said lower channel;

an upper locking plate engaging over said upper channel of said head plate for locking said front upper end and said rear lower end of said upper jack end within said upper channel;

a threaded rod extending between a first end and a second end;

said threaded rod traversing said threaded aperture of said scissor block;

a first rod mounting block rotatably securing said first end of said threaded rod to said base plate;

a second rod mounting block rotatably securing said second end of said threaded rod to said base plate; and a wheel coupled to said threaded rod for rotating said threaded rod to displace said scissor block within said lower channel for adjusting of the elevation of said head plate and the inclination of said body plate.

25. A support device for positioning an individual in an inclined orientation as set forth in claim 21, wherein said head plate further includes a head lift for adjusting the elevation of the head of the individual independently of said body plate and said head plate;

said head lift having a first vertical guide and a second vertical guide extending from the top surface of the head plate;

a head lift plate having a top surface, a bottom surface, a front edge, a rear edge, a first side edge and a second side edge;

a first guide aperture and a second guide aperture traversing said head lift plate for slidably engaging said first vertical guide and a second vertical guide respectively;

a first lift lock having a first lock aperture slidably engaging said first vertical guide;

a first lock pin traversing said head lift plate and said first lift lock for pivotably securing said first lift lock adjacent to said bottom surface of said head lift plate;

said first lift lock pivoting to a horizontal position for aligning said first lock aperture with said first vertical guide and permitting said head lift plate and said first lift lock to slidably engage said first vertical guide;

a second lift lock having a second lock aperture slidably engaging said second vertical guide;

a second lock pin traversing said head lift plate and said second lift lock for pivotably securing said second lift lock adjacent to said bottom surface of said head lift plate;

said second lift lock pivoting to a horizontal position for aligning said second lock aperture with said second vertical guide and permitting said head lift plate and said second lift lock to slidably engage said second vertical guide;

said first lift lock pivoting to a non-horizontal position for wedging said first lock aperture with said first vertical guide and terminating displacement between said head lift plate relative to said first vertical guide; and said second lift lock pivoting to a non-horizontal position for wedging said second lock aperture with said second vertical guide and terminating displacement between said head lift plate relative to said second vertical guide.

26. A support device for positioning an individual in an inclined orientation as set forth in claim 21, wherein said bead plate further includes a head lift for adjusting the elevation of the head of the individual independently of said body plate and said head plate;

said head lift having a first vertical guide and a second vertical guide extending from the top surface of the head plate;

a head lift plate having a top surface, a bottom surface, a front edge, a rear edge, a first side edge and a second side edge;

a first guide aperture and a second guide aperture traversing said head lift plate for slidably engaging said first vertical guide and a second vertical guide respectively;

a first lift lock having a first lock aperture slidably engaging said first vertical guide;

a first lock pin traversing said head lift plate and said first lift lock for pivotably securing said first lift lock adjacent to said bottom surface of said head lift plate;

said first lift lock pivoting to a horizontal position for aligning said first lock aperture with said first vertical guide and permitting said head lift plate and said first lift lock to slidably engage said first vertical guide;

a second lift lock having a second lock aperture slidably engaging said second vertical guide;

a second lock pin traversing said head lift plate and said second lift lock for pivotably securing said second lift lock adjacent to said bottom surface of said head lift plate;

said second lift lock pivoting to a horizontal position for aligning said second lock aperture with said second vertical guide and permitting said head lift plate and said second lift lock to slidably engage said second vertical guide;

said first lift lock pivoting to a non-horizontal position for wedging said first lock aperture with said first vertical guide and terminating displacement between said head lift plate relative to said first vertical guide;

said second lift lock pivoting to a non-horizontal position for wedging said second lock aperture with said second vertical guide and terminating displacement between said head lift plate relative to said second vertical guide;

a first helical spring positioned around said first vertical guide and between said head plate and said head lift plate for creating an expansion force during an ascending displacement of the head lift plate and creating resisting force during a descending displacement of the held lift plate;

a second helical spring positioned around said second vertical guide and between said head plate and said head lift plate for creating an expansion force during an ascending displacement of the head lift plate and creating resisting force during a descending displacement of the held lift plate;

a first cylindrical cushion and a second cylindrical cushion secured to said top surface of said head lift plate for preventing rotation of the head of the individual; and a first cushion cap and a second cushion cap covering said first vertical guide and said second vertical guide respectively for protecting the head of the individual.

27. A support device for positioning an individual in an inclined orientation as set forth in claim 21, wherein said front edge of said base plate including a tapered body for defining a generally linear plain between said bottom surface of said base plate and said top surface of said body plate;

a body plate cushion secured to said top surface of said body plate for padding the body of the individual;

a head plate cushion secured to said top surface of said head plate for padding the head of the individual.

28. A support device for positioning an individual in an inclined orientation as set forth in claim 21, wherein said body plate includes a first arm plate pivotably secured to said body plate for supporting the first arm of the individual;

a second arm plate pivotably secured to said body plate for supporting the second arm of the individual;

a first arm cushion secured to said first arm plate for padding the first arm of the individual;

a second arm plate pivotably secured to said body plate for supporting the second arm of the individual; and a second arm cushion secured to said second arm plate for padding the second arm of the individual.

29. A support device for positioning an individual in an inclined orientation as set forth in claim 21, wherein said rear edge of said base plate including a first handle and a second handle for grasping the support device.

30. A support device for positioning an individual in an inclined orientation as set forth in claim 21, wherein said first side edge and said second side edge of said base plate having a third handle and a fourth handle respectively for grasping the support device.

31. A support device for positioning an individual in an inclined orientation as set forth in claim 21, wherein said top surface of said base plate defining a plurality of cavities for receiving a tool.

32. A support device for positioning an individual in an inclined orientation as set forth in claim 21, wherein said rear edge of said body plate including a fifth handle and a sixth handle for grasping the support device.

33. A support device for positioning an individual in an inclined orientation as set forth in claim 21, further including a breathing circuit holder extending between a mounting end and a breathing circuit receiver end;

a flexible rod coupling said mounting end and said breathing circuit end;

a coupler securing said mounting end with said head plate;

a generally U-shaped receiver securing a breathing circuit with said breathing circuit holder, and said flexible rod permitting said generally U-shaped receiver to be positioned at multiple locations relative to said head plate.

34. A support device for positioning an individual in an inclined orientation, the individual having a head secured to a body by a neck, the support device, comprising:

a lower rectangular frame defining a first lower side, a second lower side, a front lower side and a rear lower side;

a first lower pivot secured to said first lower side of said lower rectangular frame at a first position;

a second lower pivot secured to said first lower side of said lower rectangular frame at a second position;

a third lower pivot secured to said second lower side of said lower rectangular frame at a third position;

a fourth lower pivot secured to said second lower side of said lower rectangular frame at a fourth position;

an upper rectangular frame defusing a first upper side, a second upper side, a front upper side and a rear upper side;

a first upper pivot secured to said first upper side of said upper rectangular frame at a fifth position;

a second upper pivot secured to said first upper side of said upper rectangular frame at a sixth position;

a third upper pivot secured to said second upper side of said upper rectangular frame at a seventh position;

a fourth upper pivot secured to said second upper side of said upper rectangular frame at an eighth position;

a first frame linkage extending between said first lower pivot of said lower rectangular frame to said first upper pivot of said upper rectangular frame for pivoting said upper rectangular frame relative to said lower rectangular frame;

a second frame linkage extending between said second lower pivot of said lower rectangular frame to said second upper pivot of said upper rectangular frame for pivoting said upper rectangular frame relative to said lower rectangular frame;

a third frame linkage extending between said third lower pivot of said lower rectangular frame to said third upper pivot of said upper rectangular frame for pivoting said upper rectangular frame relative to said lower rectangular frame;

a fourth frame linkage extending between said fourth lower pivot of said lower rectangular frame to said fourth upper pivot of said upper rectangular frame for pivoting said upper rectangular frame relative to said lower rectangular frame;

said first frame linkage, said second frame linkage, said third frame linkage and said fourth frame linkage defining a frame for pivoting said upper rectangular frame relative to said lower rectangular frame;

a body plate positioning between said first frame linkage and said third frame linkage for supporting the body of the individual;

a head plate positioning within said upper rectangular frame for supporting the head of the individual;

a drive engaging between said lower rectangular frame and said frame for displacing said body plate and said head plate for adjusting the height of the body and the head of the individual relative to said lower rectangular frame.

* * * * *